United States Patent [19]

Ogihara et al.

[11] Patent Number: 4,751,521

[45] Date of Patent: Jun. 14, 1988

[54] TIME RECORDER WITH AUTOMATIC CORRECTION FOR MOMENTARY DISCONTINUATION OF POWER SUPPLY

[75] Inventors: Masuo Ogihara; Hajime Oda; Tadashi Ishikawa; Atsushi Takami; Toshiya Tamura, all of Yotsukaido, Japan

[73] Assignee: Seikosha Co., Ltd., Tokyo, Japan

[21] Appl. No.: 911,249

[22] Filed: Sep. 24, 1986

[30] Foreign Application Priority Data

| | | | |
|---|---|---|---|
| Sep. 24, 1985 | [JP] | Japan | 60-210622 |
| Sep. 24, 1985 | [JP] | Japan | 60-145611[U] |
| Sep. 24, 1985 | [JP] | Japan | 60-145610[U] |
| Sep. 24, 1985 | [JP] | Japan | 60-145612[U] |

[51] Int. Cl.[4] ..... G07C 1/10

[52] U.S. Cl. ..... 346/82; 307/66; 235/377

[58] Field of Search ..... 346/82, 83; 307/64, 307/66; 235/419, 377

[56] References Cited

U.S. PATENT DOCUMENTS

| | | | |
|---|---|---|---|
| 4,170,015 | 10/1979 | Elliano et al. | 346/82 X |
| 4,270,043 | 5/1981 | Baxter et al. | 235/377 X |
| 4,333,085 | 6/1982 | Witts | 346/83 X |
| 4,401,994 | 8/1983 | Witts et al. | 346/83 |
| 4,494,127 | 1/1985 | King | 346/82 |
| 4,650,976 | 3/1987 | Hiraishi | 235/377 X |

*Primary Examiner*—A. D. Pellinen

*Assistant Examiner*—Derek S. Jennings

*Attorney, Agent, or Firm*—Bruce L. Adams; Van C. Wilks

[57] ABSTRACT

A time recorder is normally powered by a main power source for supplying a commercial power and occasionally powered by a back-up power source during interruption of the commercial power supply. A clock means counts time to constantly produce a clock pulse, and a digital display constantly digitally indicates updated time data in response to the clock pulse. An analogue display is driven for analogically indicating time information and a recording mechanism is driven for recording time information on a recording medium. A driving device drives the analog display and recording mechanism in response to the clock pulse to update the time information indicated in the analog display and recorded by the recording mechanism. A detecting device is connected to the main power source for detecting the interruption of the commercial power supply. A controlling device responsive to the detection of the commercial power supply interruption inhibits the operation of the driving device during the commercial power supply interruption so that the driving device suspends the driving of the analog display and recording mechanism to thereby cause a delay of the time information from the updated time data, and operates after recovery of the commercial power supply for controlling the driving device to quickly drive the analog display and recording mechanism to correct for the delay to thereby update the time information.

17 Claims, 22 Drawing Sheets

TIME RECORDER WITH AUTOMATIC CORRECTION FOR MOMENTARY DISCONTINUATION OF POWER SUPPLY

BACKGROUND OF THE INVENTION

1. Field of the Invention

This invention relates to a time recorder, and more particularly to a technique to compensate for commerical power supply interruption in a time recorder having a digital display and an analog display.

2. Description of the Prior Art

A time recorder in which an electronic clock is used as a clock system employs the commercial power supply as a source of energy for operation thereof since the time recorder necessitates a high electric power for its operation due to the fact that rotation of a steeping motor is transmitted to drive printing wheels in a timed relationship via several wheels and a ratchet mechanism and printing operation is effected by a hammer which is actuated by a solenoid.

Accordingly, in a conventional time recorder, a countermeasure when the supply of the commercial power is inadvertently shut down due to service interruption or disconnection of a power supply plug, a digital display device, an analog display device and a time printing mechanism are stopped while only a clocking function is kept operative by a backup cell, and then upon recovery of the commercial power supply, the present time is indicated on the digitial display device while the analog display device and the time printing mechanism are caused to move momentarily until respective reference positions thereof are found out and then correcting operations are carried out when the present time coincides to the reference position. When the power supply interruption occurs frequently, there are problems that a considerable time is required for such correcting operations, a mechanism for detecting the reference positions is required and the present time cannot be observed during the commercial power supply interruption.

In another conventional time recorder which includes both a large size hand-type time display mechanism and a digital display mechanism which normally indicates the month and day, the commercial power supply is employed as a driving energy source because a high driving force is required for the hand-type time display mechanism. On the other hand, the digital display mechanism requires only a low power consumption and is thus backed up by an auxiliary power source such as a battery to continue the indication of the month and day. However, since the time is no more indicated, it is a problem that the clock is inconvenient to a user. In order to eliminate such a problem, it may be possible to change over the contents of indication of the digital display mechanism from the date to the time so that a user may not feel inconvenience. However, there still is a problem that, regardless of the commercial power supply interruption, a user may unconsciously recognize the incorrect indication of the analog display mechanism as the present time due to the form of indication which has been normally familiar to the user.

The conventional time recorder in which an electronic clock is used as a clock system employs the commercial power supply as a source of energy for operation thereof since it necessitates a high electric power for its operation due to the fact that rotation of a stepping motor is transmitted to drive printing wheels in a timed relationship via a wheel train and a ratchet mechanism and printing operation is effected by a hammer which is actuated by a solenoid.

Accordingly, in the conventional time recorder, there is a problem that when the supply of the commercial power is inadvertently interrupted due to service shut-down or disconnection of a power supply plug, a wheel train and a ratchet mechanism during rotation will be halted midway so that, upon recovery of the commercial power supply, they will start from incorrect positions thereof, and hence upon subsequent printing operation, the printing wheels and a card feed mechanism will not stop at correct positions, resulting in printing error.

Another conventional time recorder normally employs the commercial power supply as a source of energy since it drives a high mechanical load such as a printing wheel and a hammer while a clock circuit wherein power consumption is relative low is backed up by an auxiliary power source such as a battery to obtain an accurate time signal regardless of the commercial power supply interruption so that, upon recovery from the service interruption, the printing wheel may be automatically corrected to the present time in accordance with the time signal.

By the way, it is sometime necessary, for example, upon shipment from a factory or for a business talk, to demonstrate that, after the service interruption, a printing wheel and/or an analog display mechanism are automatically corrected to the present time. In such a case, normally an operation is required to arbitrarily interrupt the supply of the commercial power supply and keep it interrupted for a sufficient interval of time to allow a sufficient difference to appear between the printing wheel and/or analog display mechanism and a time reference signal and thereafter to supply the power again to cause the printing wheel and the analog display mechanism operative. Therefore, it is a disadvantage that there is considerable waste time.

SUMMARY OF THE INVENTION

The present invention has been made in view of such problems as described above, and it is a first object of the invention to provide a time recorder wherein the present time can be indicated even during the service interruption, a time required for correction is short where the service interruption occurs frequently, and such a reference position detecting mechanism as mentioned above can be eliminated.

In order to attain the first object, according to the present invention, the present time is indicated on a digital display device during the service interruption while an analog display device and a time printing mechanism are stopped, and either of the time at which the service interruption starts or a time interval during which the service interruption has continued is stored in memory so that, upon recovery of the commercial power supply, the analog display device and the time printing mechanism are automatically corrected by an amount corresponding to such a time interval during which the service interruption has continued in accordance with the stored value.

It is a second object of the invention to provide an analog and digital clock in a time recorder wherein, upon the service interruption, indication of the time can be changed over to digital indication, and at the same time, the attention of a user can be drawn to the digital indication to allow the user to recognize the accurate time. In order to attain the second object of the present invention, the present invention is characterized in that, upon the commercial power supply interruption, stationary digital indication is changed to flickering indication.

It is a third object of the invention to provide a time recorder wherein, when the supply of the commercial power is interrupted during operation of a wheel train and/or a ratchet mechanism, power is supplied from an auxiliary power source to a motor to feed the wheel train and/or the ratchet mechanism one full cycle to regular meshing positions to thereby allow correct printing after recovery from the service interruption.

It is a fourth object of the invention to provide a time recorder wherein operation of an automatic correcting function of the time can be demonstrated in a short time by a simple operation.

In order to achieve the fourth object, the present invention is characterized in that a clock circuit which is operated by a backup power source can be corrected from outside even during the service interruption of the commercial power supply.

DETAILED DESCRIPTION OF THE PREFERRED EMBODIMENTS

Now, the present invention will be described in detail in conjunction with preferred embodiments illustrated in the accompanying drawings.

Figure 2:
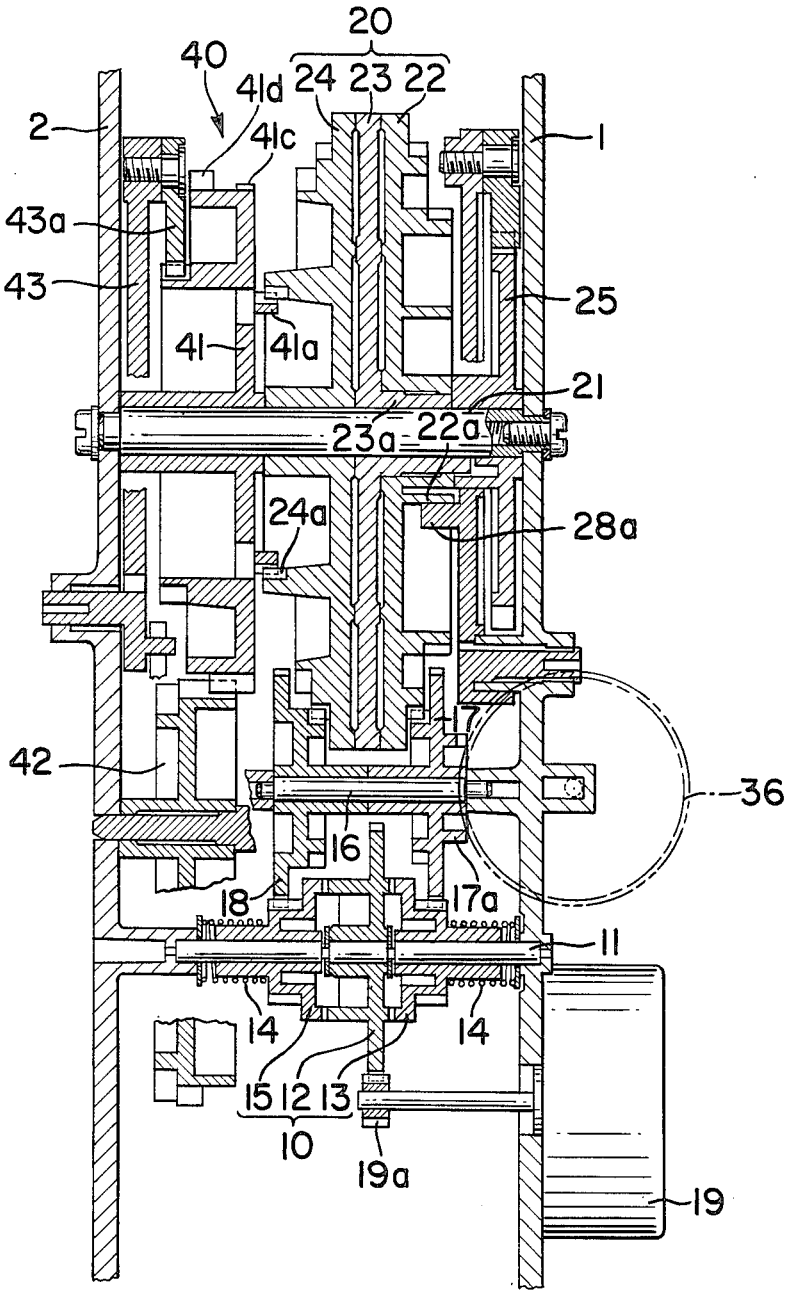
FIG. 2 is a cross sectional view showing essential part of a time recorder according to the invention.

FIG. 2 shows essential part of a first embodiment to which the present invention is applied. The structure shown generally includes a clutch mechanism 10 connected to be driven by a stepping motor 19, a set of printing wheels 20 connected to be driven by the clutch mechanism 10, a transmission mechanism 30 (FIG. 3) for transmitting rotation to a pair of hands 37, 38 by way of a minute deceleration wheel 17, a feed mechanism 40 (FIG. 6) connected to be driven by a date printing wheel 24 to stepwisely feed a card, and a printing mechanism 50 (FIG. 6) for printing the date and time on a card inserted into the time recorder.

The individual mechanisms are now described in detail. A clutch wheel shaft 11 is supported on and extends between a right side wall 1 and a left side wall 2, and has a clutch wheel 12 loosely fitted on the shaft 11 and meshed with a pinion **19*a* which is secured to a shaft of the stepping motor 19. A minute clutch wheel 13 and a day clutch wheel 15 are loosely fitted on the clutch wheel shaft 11 and are urged in an axial direction toward the clutch wheel 12 located therebetween and thus toward each other by means of a pair of coil springs 14 interposed between the minute clutch 13 and the right side wall 1 and between the day clutch wheel 15 and the left side wall 2**, respectively.

Figure 4:
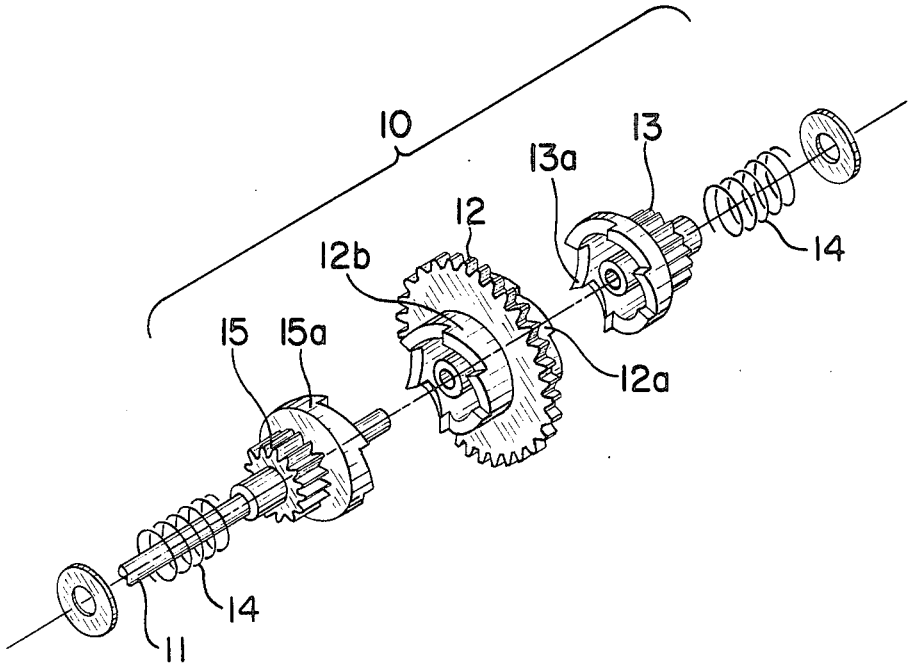
FIG. 4 is a fragmentary perspective view of a clutch mechanism.

FIG. 4 shows the clutch mechanism 10 in a fragmentary representation. The clutch wheel 12 has a minute feed cylinder **12*a* and a day feed cylinder 12*b* formed to extend integrally from opposite faces of the clutch wheel 12. The minute and day feed cylinders 12*a*, 12*b* of the clutch wheel 12 have clutch teeth protruding in opposite directions at end faces thereof. Meanwhile, the minute clutch wheel 13 and the day clutch wheel 15 have a minute feed cylinder 13*a* and a day feed cylinder 15*a* formed projectingly on inner ends thereof, respectively. The minute and day feed cylinders 13*a*, 15*a* of the minute and day clutch wheels 13, 15 have clutch teeth formed on end faces thereof and meshed with the clutch teeth of the minute and day feed cylinders 12*a*, 12*b* of the clutch wheel 12, respectively. Accordingly, as the clutch wheel 12 undergoes one complete rotation in a clockwise direction in FIG. 4 for each minute, the minute clutch wheel 13 meshed with the minute feed cylinder 12*a* rotates a minute printing wheel 22 described below by one step by way of the minute deceleration wheel 17 (FIG. 2). On the other hand, as the clutch wheel 12 rotates in a counterclockwise direction in FIG. 4 at each 0 a.m., the day clutch wheel 15 meshed with the day feed cylinder 12*b* of the clutch wheel 12 rotates a day printing wheel 24 described below by one step by way of a day deceleration wheel 18** (FIG. 2).

Referring back to FIG. 2, the set of printing wheels 20 for printing the date and time at a required location of a time card C includes a minute printing wheel 22, a hour printing wheel 23 and a day printing wheel 24, each having the same diameter and having types of characters of 1 to 60, 1 to 24 and 1 to 31 arranged on peripheries thereof, respectively. The day printing wheel 24 which is connected through the day deceleration wheel 18 to the day clutch wheel 15 is loosely fitted around a printing wheel shaft 21 together with the hour printing wheel 23. Meanwhile, the minute printing wheel 22 which is meshed with the minute clutch wheel 13 via the minute deceleration wheel 17 is loosely fitted around a hub 23*a* of the hour printing wheel 23 and is thus located adjacent the hour and day printing wheels 23, 24.

Figure 5A:
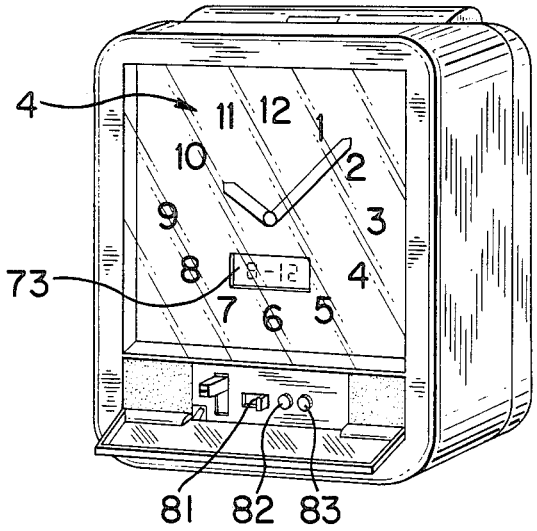
FIG. 5A is a front elevational view showing the appearance of the time recorder.
Figure 5:
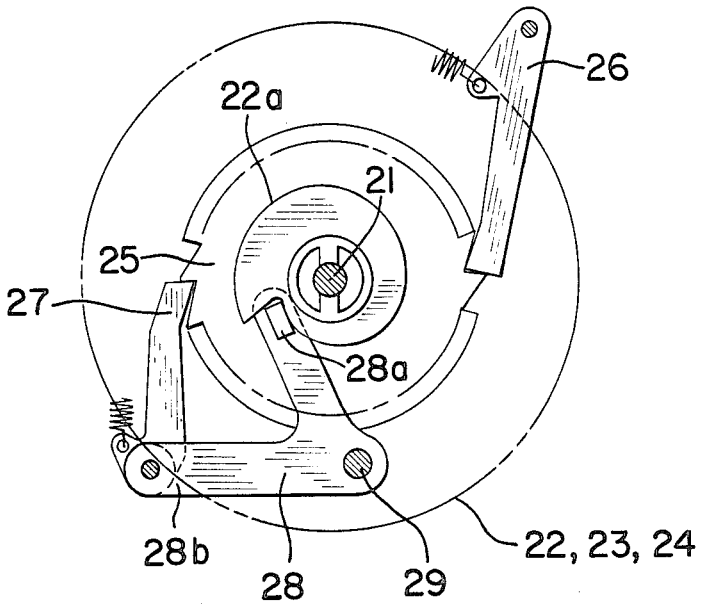
FIG. 5 is a plan view of a ratchet wheel for driving an hour printing wheel.

A ratchet wheel 25 for driving the hour printing wheel 23 is connected to an end of the hub 23*a* of the hour printing wheel 23 for integral rotation therewith and has up to twenty four ratchet teeth formed on a circumferential periphery of the ratchet wheel 25 and adapted to be engaged with a detent pawl 26 and a feed pawl 27 as shown in FIG. 5. The feed pawl 27 is supported for rocking movement at an end 28*b* of an arm of a feed lever 28 supported for pivotal movement on a fixed shaft 29. The feed lever 28 has a cam follower 28*a* located at an end of the other arm of the feed lever 28 and slidably engaged with an outer periphery of a small-shaped peripheral cam 22*a* integral with the minute printing wheel 22 so that the feed lever 28 can be rocked by the peripheral cam 22*a* to feed the ratchet wheel 25 once for an hour to rotate the hour printing wheel 23 by one step in the clockwise direction in FIG. 5.

Figure 3:
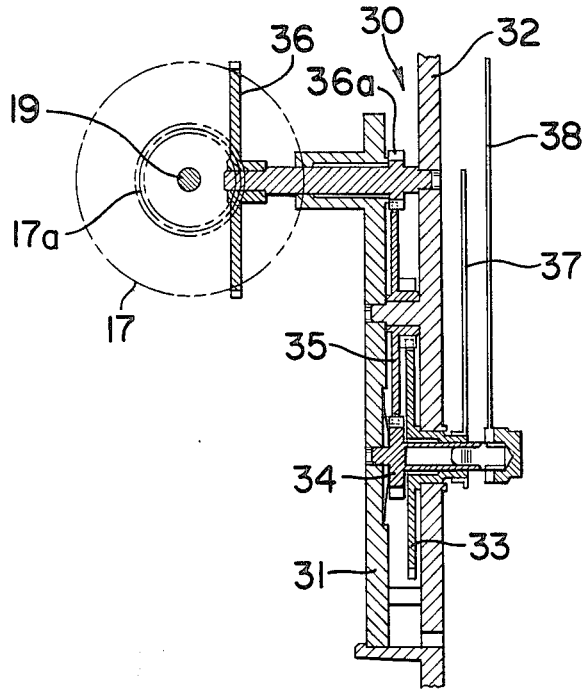
FIG. 3 is a cross sectional view of a transmission mechanism.

On the other hand, a clock top plate 31 is disposed in a plane parallel to the plane of FIG. 2, that is, perpendicular to the right side wall 1 and the left side wall 2. FIG. 3 shows the transmission mechanism 30 on the top plate 31. A dial plate 32 is located in a spaced relationship in front of the top plate 31. A transmission wheel 35 is located between the top plate 31 and the dial plate 32 and is meshed with a clock wheel 33 and a minute time pinion 34. The transmission wheel 35 is coupled via a pinion 36*a* to an intermediate transmission wheel 36 which is meshed with a crown gear 17*a* integral with the minute deceleration wheel 17 (FIG. 3) so that the rotation thereof can be transmitted to an hour hand 37 and a minute hand 38 with the ratio of 1:12.

Figure 7:
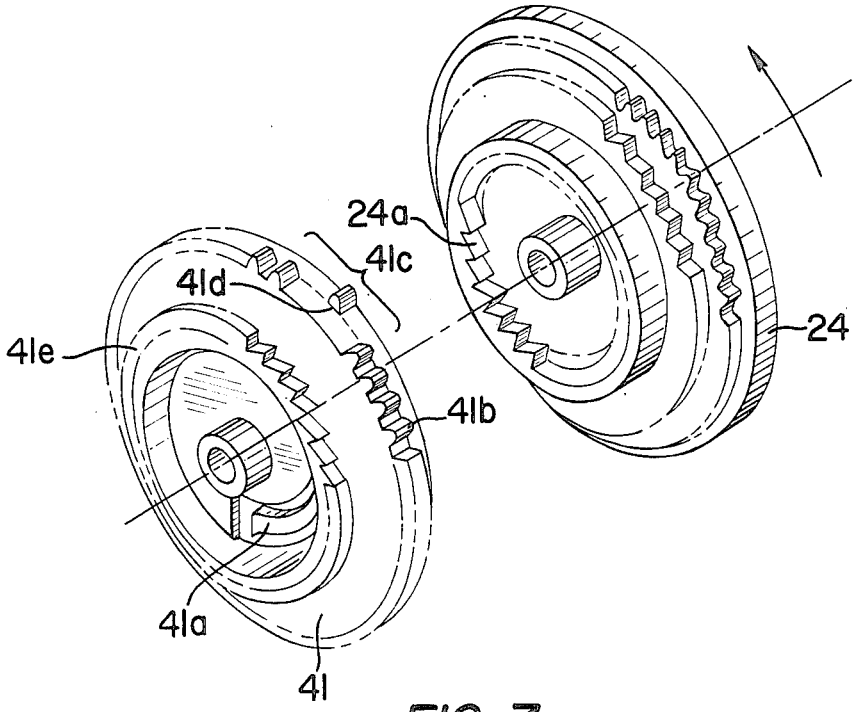
FIG. 7 is a side elevational view of a step feed mechanism.

Now, the step feed mechanism 40 to which a driving force is applied from the day printing wheel 24 (FIG. 2) will be described. A first step feed wheel 41 of the step feed mechanism 40 is fitted around the printing wheel shaft 21 adjacent the day printing wheel 24. The first step feed wheel 41 has a pair of pawl pieces 41*a* each in the form of a cantilever formed on a face thereof by stamping. The pawl pieces 41*a* of the first step feed wheel 41 are engaged at free ends thereof with inner ratchet teeth 24*a* provided on a side face of the day printing wheel 24 so that each time the day printing wheel 24 rotates in a direction indicated by an arrow mark in FIG. 7 once for a day, the first step feed wheel 41 is moved stepwise in the same direction with the day printing wheel 24.

Figure 6:
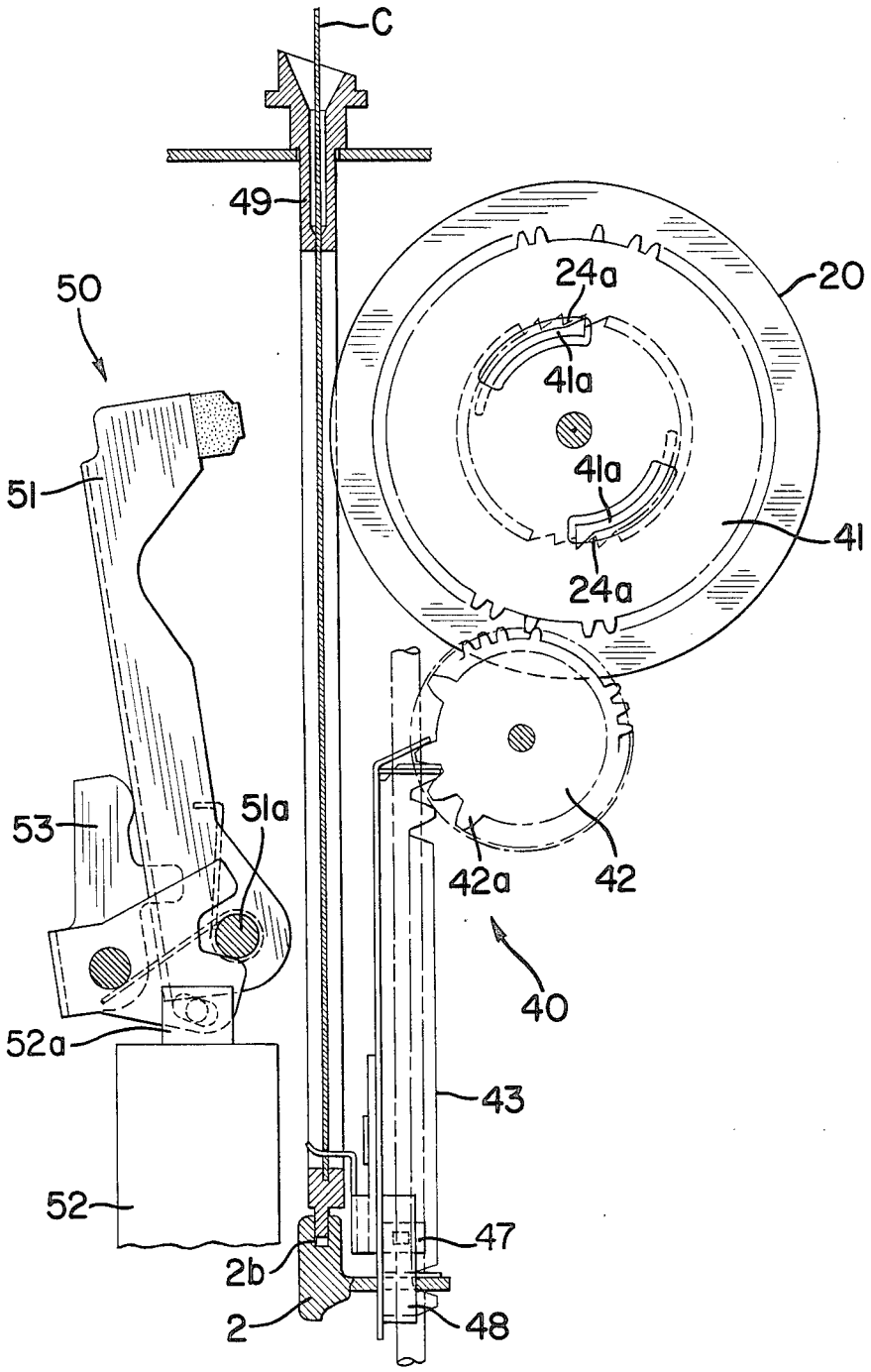
FIG. 6 is a side elevational view of a printing mechanism.

By the way, FIG. 6 shows the printing mechanism 50 located at a rear portion within a body of the apparatus. A card guide 49 for guiding a card C inserted into the apparatus body from the top opening of the card guide 49 is located adjacent a rear face of the printing wheel set 20 and is mounted in a guide groove 2*b* of the side wall 2 such that the card C can move in an axial direction along a circumferential face of the printing wheel set 20. A hammer 51 is located behind the card guide 49 and is mounted for pivotal movement around a pin 51*a* with an end thereof positioned in the neighborhood of a portion of the circumferential face of the printing wheel set 20 at which the card C is contacted with printing wheel set 20. The hammer 51 is connected, via a rocking lever 53 coupled to a plunger 52*a* of a solenoid 52, to be driven by the solenoid 52 which operates in response to a card detecting switch 48.

Now, a driving circuit for controlling operation of the mechanisms described above will be described.

Figure 1:
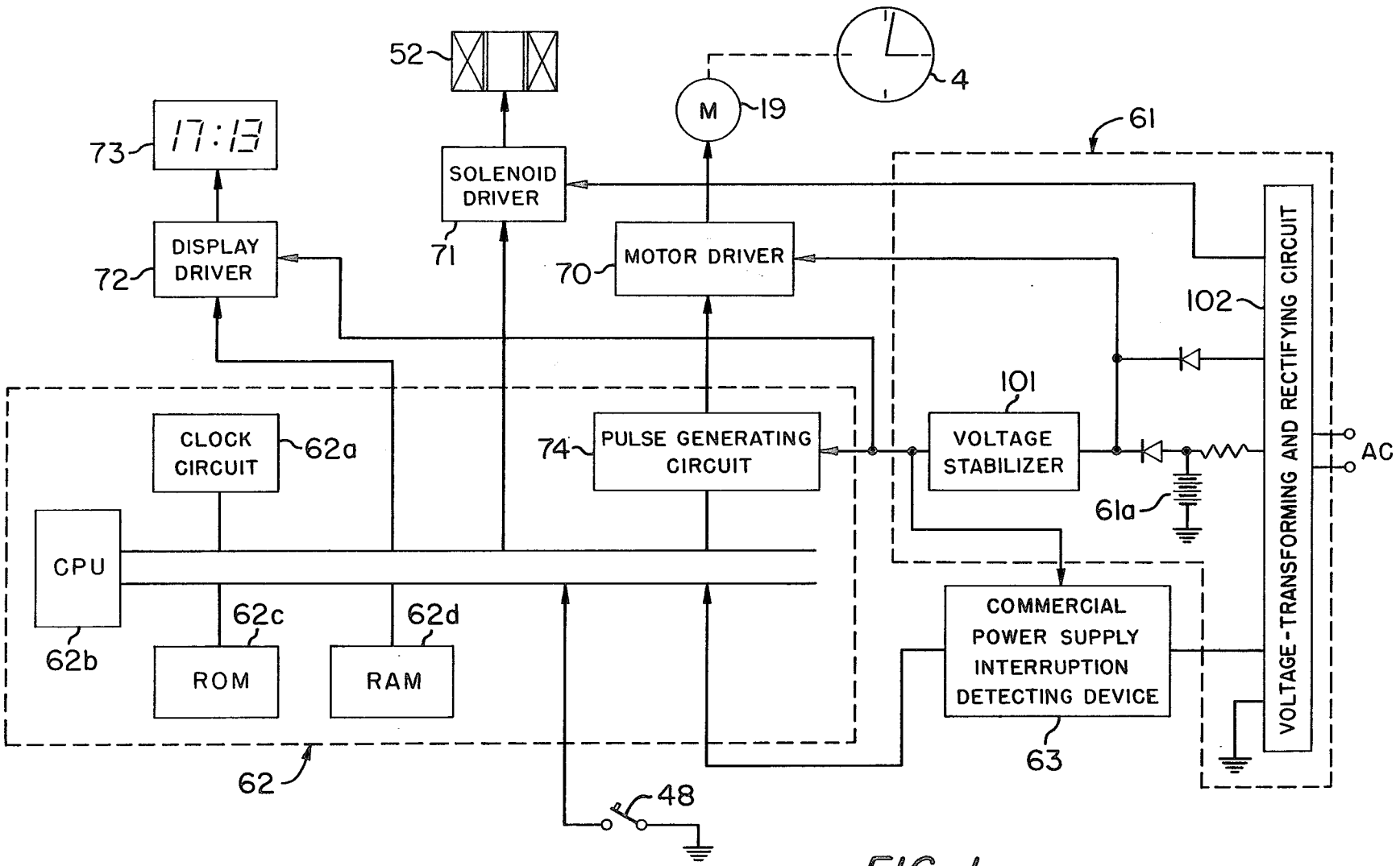
FIG. 1 is a block diagram showing an embodiment of a driving circuit for controlling operation of printing wheels of a time recorder according to the present invention.

FIG. 1 illustrates an embodiment of a driving circuit which includes a main power source device 61, a controlling device 62 and a commerical power supply interruption detecting device 63. The power source device 61 includes voltage-transforming and rectifying circuit 102 which rectifies the commercial power supply into a dc power and supplies a driving power to a motor driver 70 and a solenoid driver 71, and while charging a secondary cell or back-up power source 61*a* in a floating state. The secondary cell 61*a* supplies an operating power through a voltage stabilizer 101 to the controlling device 62 and a display driver 72. The controlling device 62 includes a clock circuit 62*a* for constantly counting the time and generating a reference timing signal in the form of a clock pulse, a CPU 62*b*, a ROM 62*c* in which a control program for controlling operation of the CPU 62*b* is stored, and a RAM 62*d* for storing therein reference time data representative of the time at which the power supply service interruption is started. The controlling device 62 is connected to receive signals from the card detecting switch 48 and the service interruption detecting circuit 63 and to deliver a time signal to the display driver 72 and the motor driver 70 and a printing instruction signal to the solenoid drive 71.

Figure 9A:
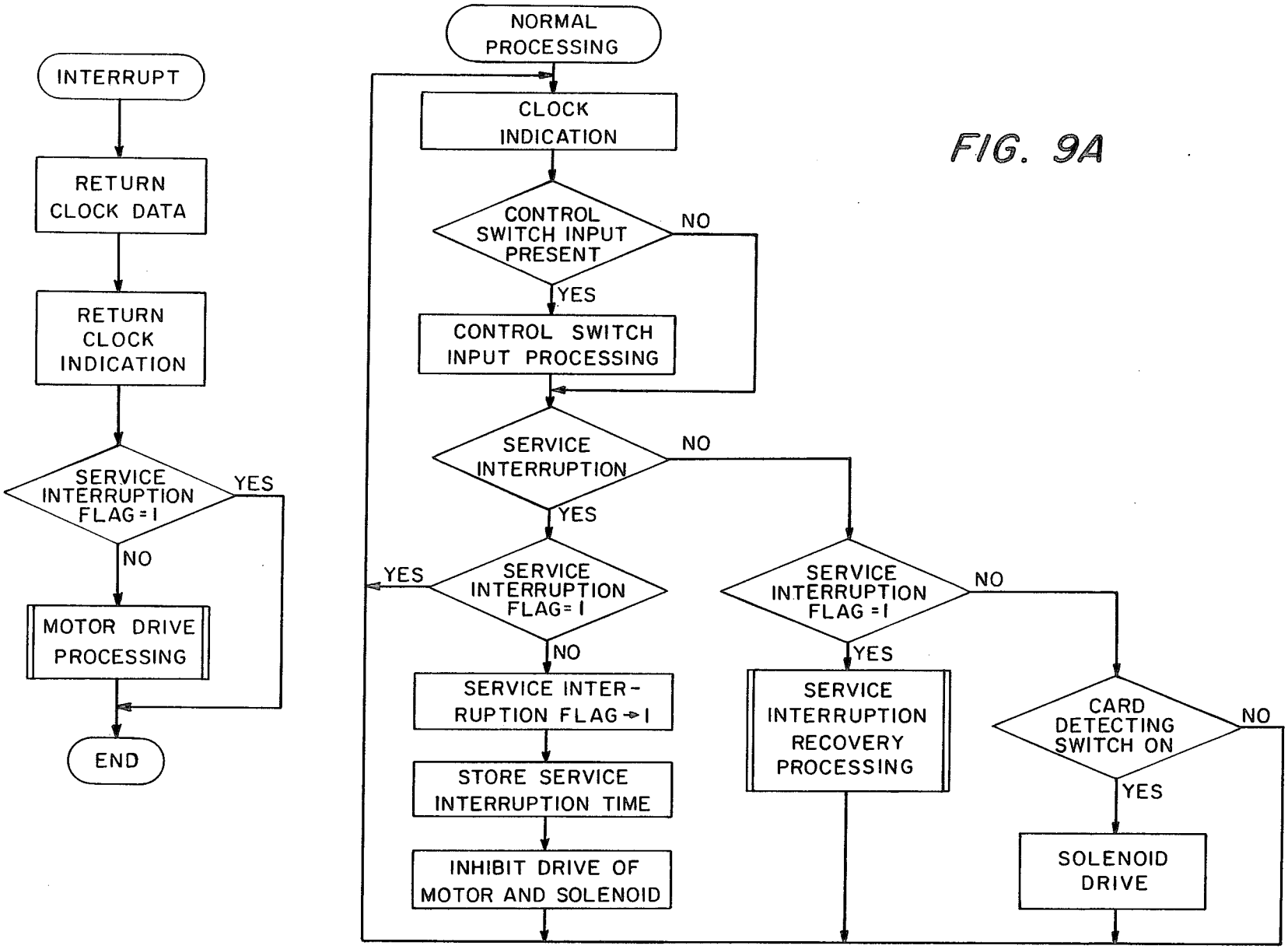
FIGS. 9A, 9B and 10A, 10B are flow charts illustrating operations of the driving circuit of FIG. 1.
Figure 9B:
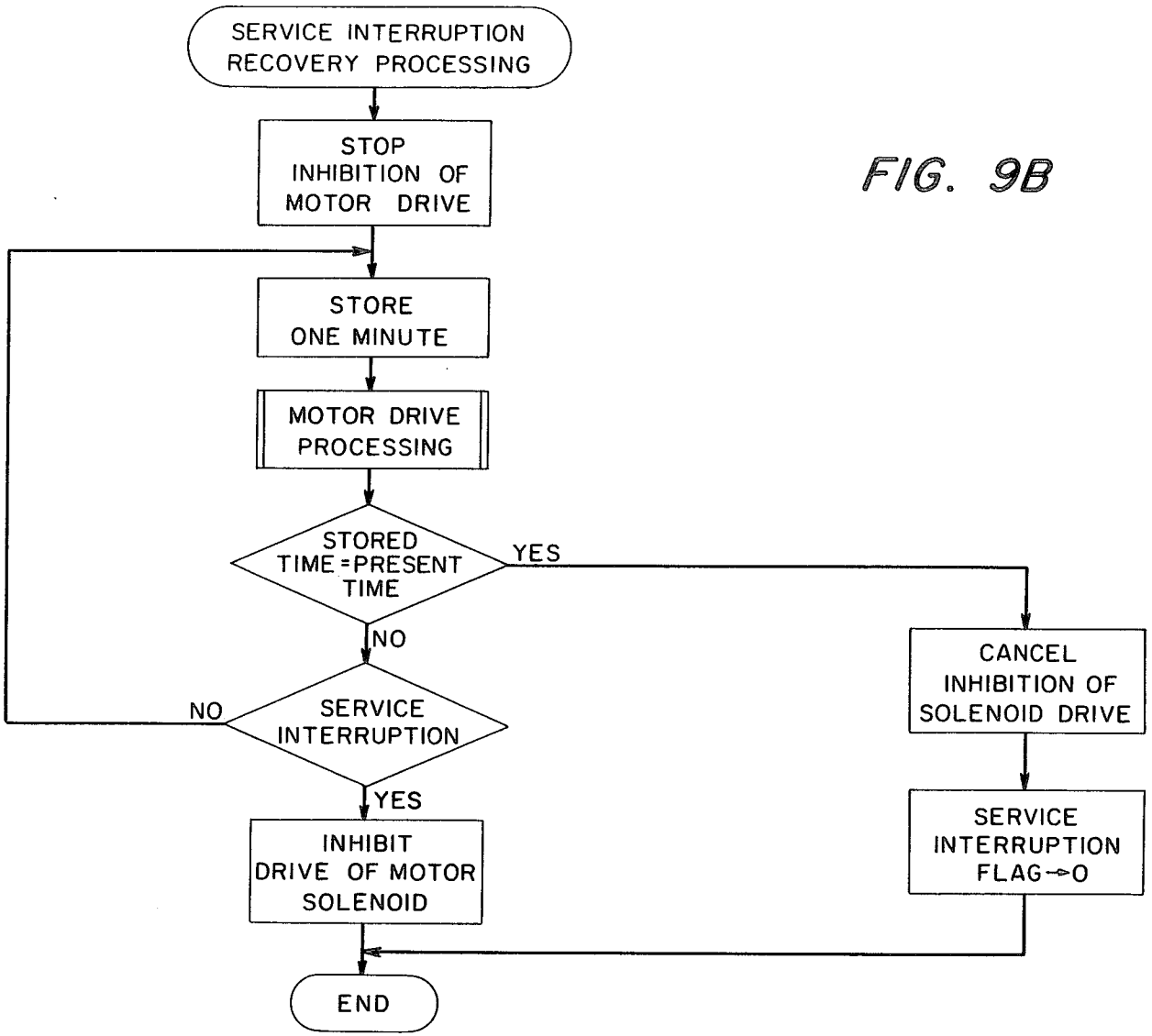
Figure 10A:
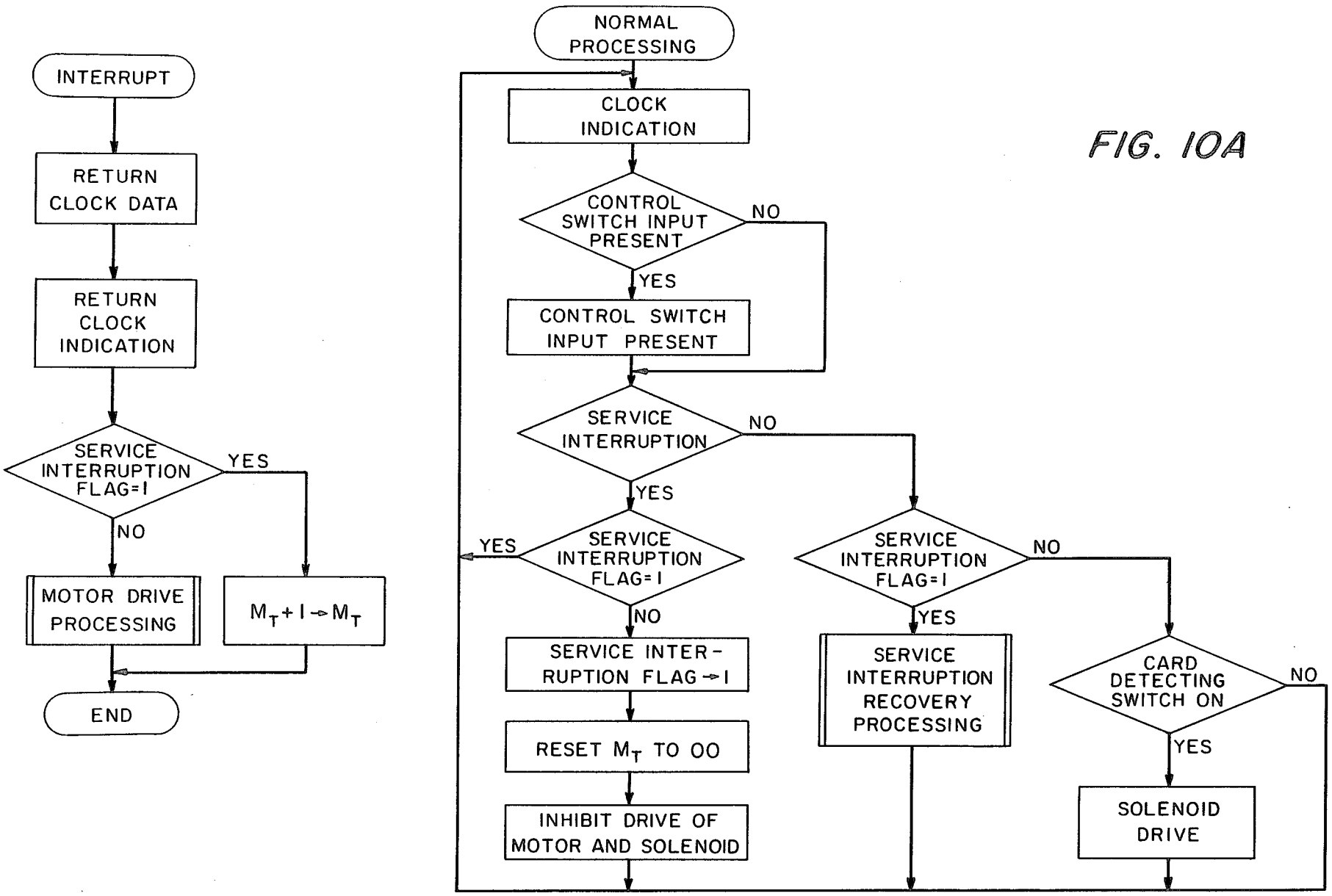
Figure 10B:
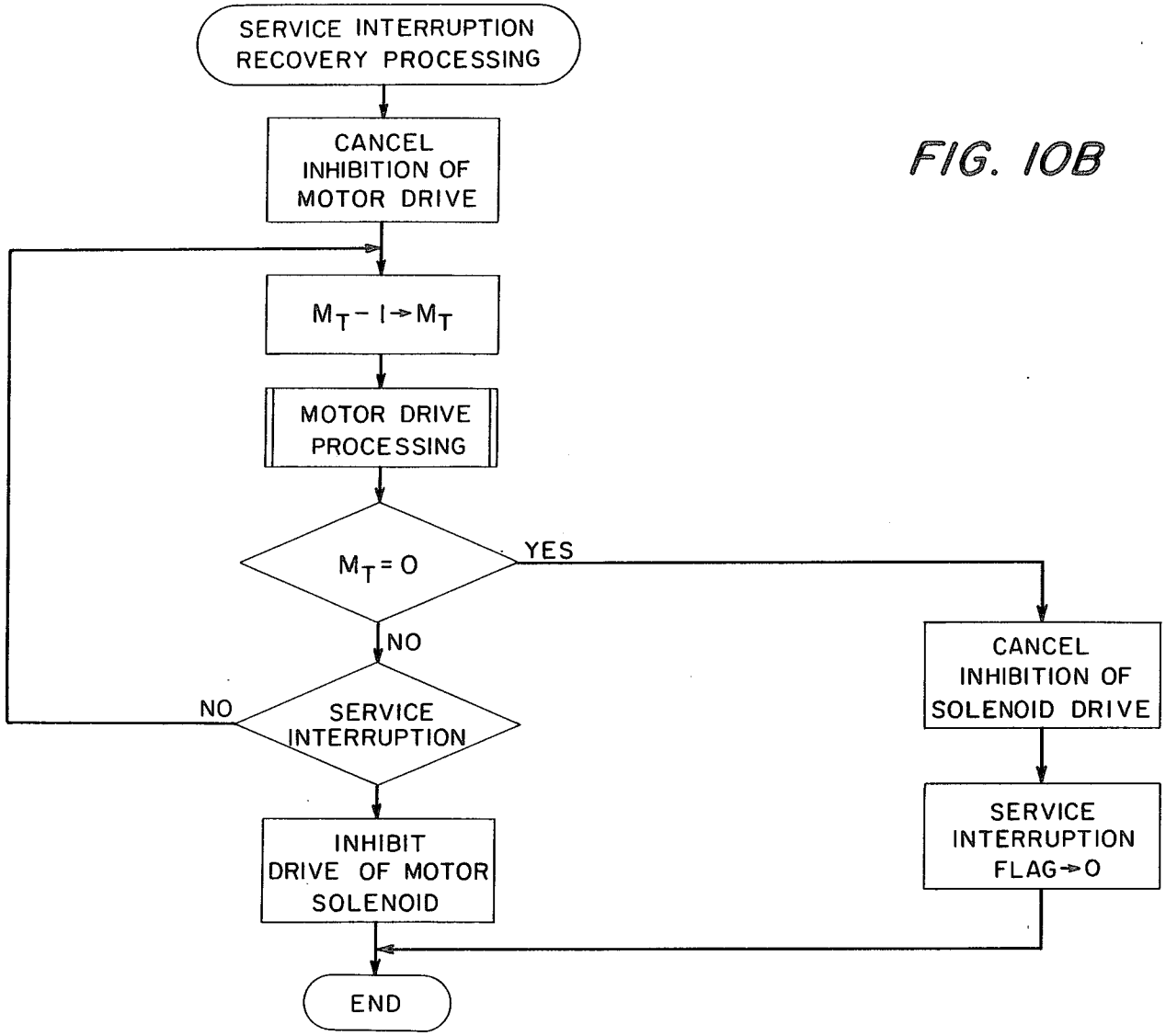

Operation of the apparatus having such a construction as described above will now be described with reference to a timing chart shown in FIG. 8 and a flow chart shown in FIGS. 9 and 10.

While the commercial power supply is supplied to the power source device 61, and L level signal is developed from the service interruption detecting circuit 63 and hence power from the commercial power supply is supplied to the individual parts of the apparatus. Each time a minute signal is applied to a pulse generating circuit 74 for each minute from the clock circuit 62*a*, a number of motor drive pulses required to cause the stepping motor 19 to rotate one complete rotation are developed from the pulse generating circuit 74. Consequently, the clutch wheel 12 is rotated in the clockwise direction in the drawing via the pinion 19*a* to rotate the minute printing wheel 22 one step corresponding to a pitch between adjacent character types thereon via the minute clutch wheel 13 and the minute deceleration wheel 17. Thus, upon subsequent rotation after the type of character "59" on a shoulder of the minute printing wheel 22 has come to a position opposing to the end of the hammer 51, the cam follower 28*a* is dropped from the lobe of the peripheral face of the cam 22*a* rotating in the integral relationship with the minute printing wheel 22 to cause the feed lever 28 to rock in a direction to feed the ratchet wheel 25 by one tooth pitch by means of the feed pawl 27 at the end 28*b* of the feed lever 28 thereby to integrally rotate the hour printing wheel 23 by one hour pitch.

On the other hand, the transmission wheel 36 meshed with the crown gear 17*a* of the minute clutch wheel 13 transmits the rotation of the minute clutch wheel 13*b* to the transmission wheel 35 to advance the minute hand 38 and the hour hand 37 by respective pitches corresponding to one minute and one hour.

If the time comes to 0:00 a.m. in this manner, reverse driving rules from the pulse generating circuit 74 are developed directly after completion of the operation described above so that the reverse driving pulses in a reverse phase but having a lower repeat frequency than that of the driving pulses in a normal phase are applied to the stepping motor 19.

Consequently, the stepping motor 19 is rotated at a lower speed but in the reverse direction. Accordingly, the day clutch wheel 15 which has been stationary is now driven to rotate by the clutch teeth provided on the day feed cylinder **12*b* of the clutch wheel 12 to advance the day printing wheel 24 by one day pitch via the day deceleration wheel 18. On the other hand, as the day printing wheel 24 rotates, the first step feed wheel 41 is rotated by way of the pawl pieces 41*a* engaged with the ratchet inner teeth 24*a* of the day printing wheel 24 so that a rack rod 43 is displaced upwardly by one tooth pitch by a rack feed gear 42*a* of the second step feed wheel 42 meshed with the first step feed wheel 41. In this instance, as the rack rod 43 is pulled up, a high load is applied to the stepping motor 19. However, since the stepping motor 19 is driven in response to the reverse driving pulses of a low repeat frequency as described hereinabove, the output torque is high enough to pull up the rack rod 43 without causing disengagement of the rack rod 43 from the rack feed gear 42*a***.

Figure 8:
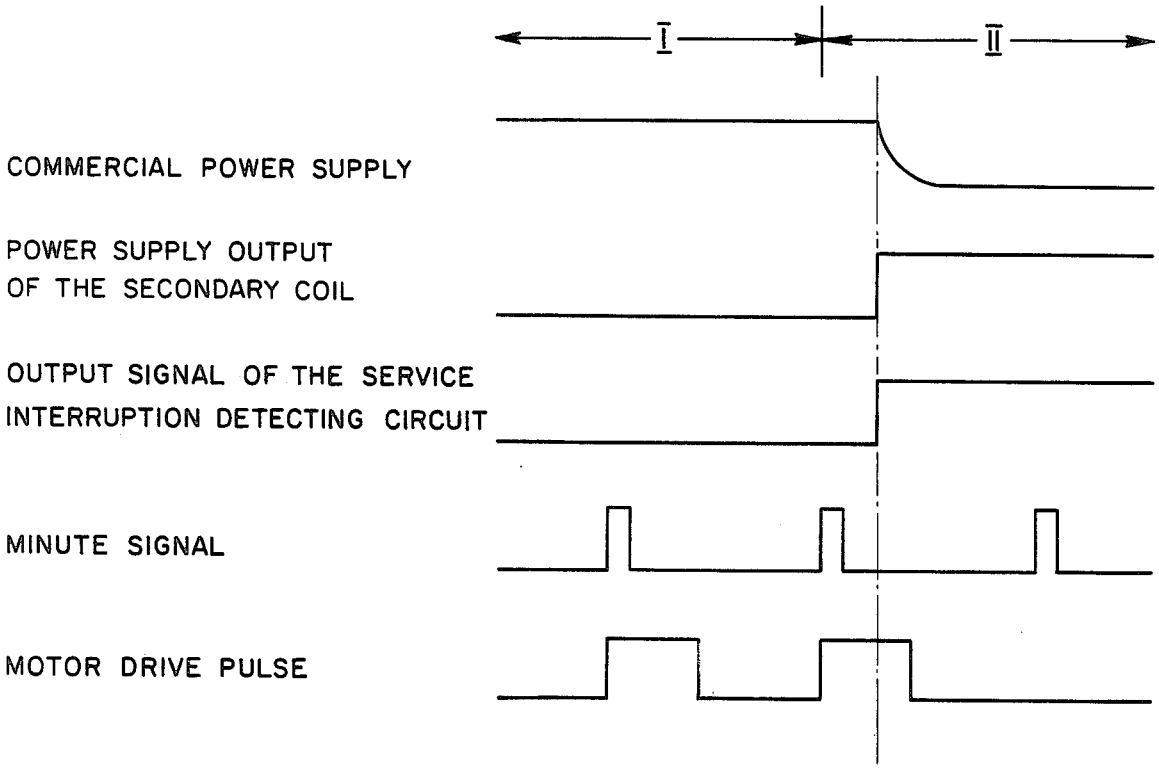
FIG. 8 is a timing chart illustrating operations of the driving circuit shown in FIG. 1.

After completion of the day changing over operation in this manner, the driving pulses in the normal phase are developed from the pulse generating circuit 74 in response to the minute signal from the clock circuit **62*a* for each minute to rotate the stepping motor 19 forwardly as shown in the left hand portion I of FIG. 8**.

If a time card is inserted into the apparatus, the CPU **62*b* receives a signal from the card detecting switch 48 and operates the solenoid driver 71 to drive the solenoid 52 to cause the printing hammer 51** to print the date and time information at a predetermined position of the card.

Figure 11:
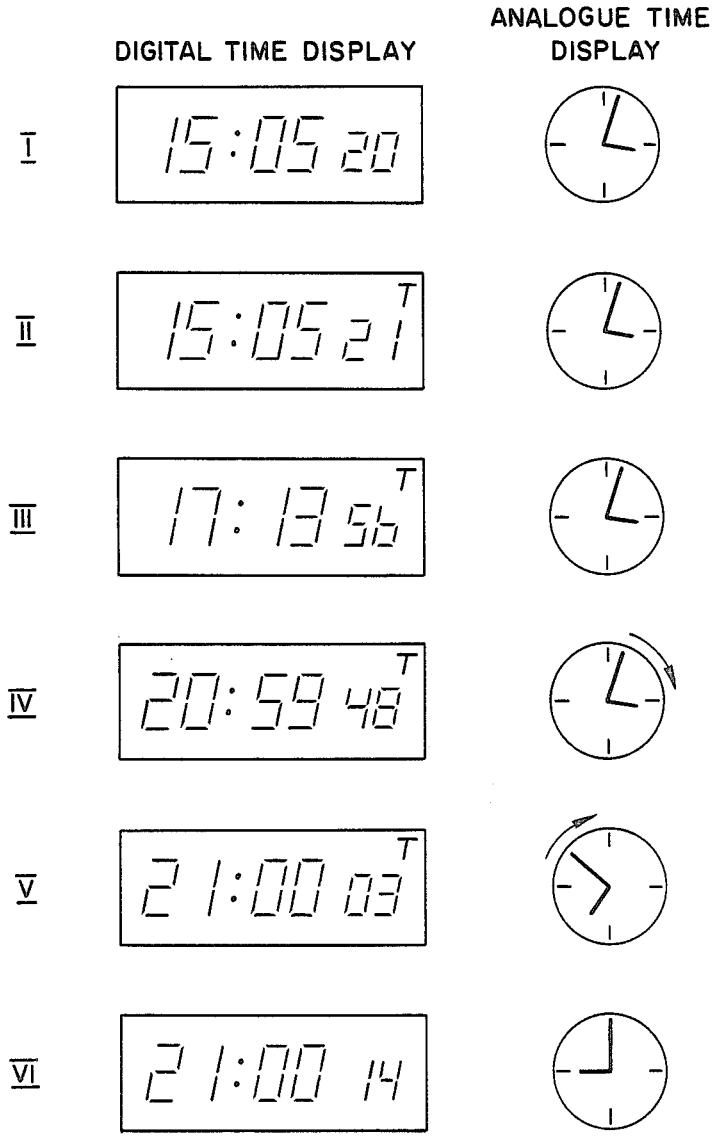
FIG. 11 is a diagrammatic representation illustrating operations of the driving circuit of FIG. 1.

By the way, if the commercial power supply is shut down due to service interruption or by some other reasons during the normal operation of the apparatus as shown at I in FIG. 11, the controlling device 62 receives supply of power from the secondary cell **61*a* for back-up to continue the operating condition, while the service interruption detecting circuit 63 reverses its output to an H level in response to the interruption of the supply of the commercial power. Upon reception of the H level signal, the CPU 62*b* stores the time of the clock circuit 62*a*, that is, the time when the service interruption occurs into the RAM 62*d*, while the CPU 62*b* causes the digital display 73 to indicate, at a corner thereof, an indication T representing that the power supply is interrupted now (II in FIG. 11). Simultaneously, the CPU 62*b* inhibits delivery of the driving signals to the solenoid driver 71 and the motor driver 70. Accordingly, even if a minute clock signal or a printing instruction signal is developed from the controlling device 62, the motor driver 70 and the solenoid driver 71 are suspended to hold their inoperative conditions to prevent useless consumption of power of the back-up secondary cell 61*a*. On the other hand, the controlling device 62 including the clock circuit 62*a* is supplied with the power from the back-up cell 61*a* of the power source device 61 to continue the clocking operation in a similar manner as before the service interruption to indicate the present or update time on the digital display 73 (III in FIG. 11**).

In this condition, if the commercial power supply becomes available again due to recovery from the service interruption, the service interruption detecting circuit 63 reverse its output and now feeds an L level signal to the controlling device 62. Consequently, the CPU **2*b* discontinues the operation inhibiting condition for the motor driver 70 and feeds correction signals having a repeat frequency higher than the normal clock or minute signals to the motor driver 70 to compensate for the delay caused by the service shut down based on the service interruption starting time stored in the RAM 62*d*. The motor 19 receives the motor drive pulses in response to the correction signals having such a higher repeat frequency and quickly drives the analog time display mechanism 4 and the set of printing wheels 20 (IV, V in FIG. 11). Such a series of quick operations as described above is repeated until the analogue time display is advanced by the correction signals to coincide with the present time which is continuosly measured by the clock circuit 62*a* whereupon the development of the correction signals for quick feeding is stopped and at the same time the solenoid driver 71 which has been stopped is now enabled for operation. Accordingly, the time indication by the analog time display mechanism 4 and the set of printing wheels 20 for the day, hour and minute are automatically corrected or updated to the present time (VI in FIG. 11**).

It is to be noted that while, in the present embodiment, the time at which the supply of the commercial power is interrupted is stored in the RAM **62*d***, similar effects can be expected naturally if otherwise a number of pulses are developed which corresponds to a total value of a time interval from the starting of the service interruption to the recovery from the service interruption and a time interval required for the correction of the time, that is, a time from the starting of the service interruption to the completion of correction.

As apparent from the foregoing description, according to the present invention, the digital means always provides the present time indication even during the service interruption so that the present time can be seen from such indication. Besides, since the time at which the service interruption starts or a time interval during which the service interruption has continued is stored in memory and, upon recovery of the power supply, the analog means and the time printing mechanism are automatically corrected by an amount corresponding to the time interval during which the service interruption has continued in accordance with the stored value, a reference position mechanism can be eliminated. In addition, even if service interruption occurs frequently, a time required for the correction is very short.

SECOND EMBODIMENT

Now the second embodiment will be described in detail in conjunction with the drawings.

Figure 3A:
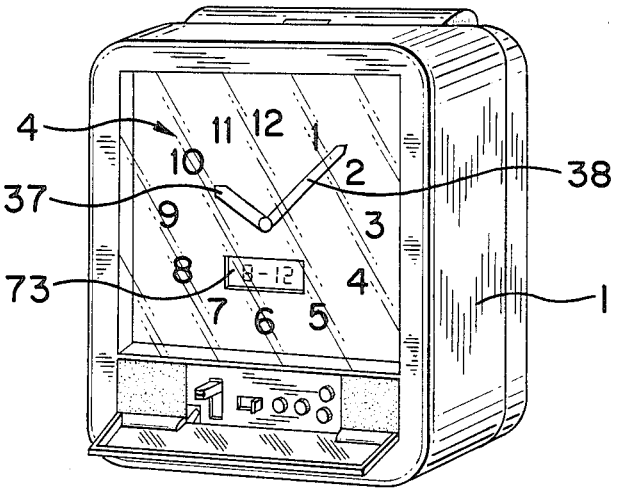
FIG. 3A is a front elevational view showing the appearance of an analog and digital clock apparatus to which the present invention is applied.

FIG. 3A shows an embodiment of a time recorder which includes an analog and digital clock to which the invention is applied. The time recorder includes an analog display mechanism 4 including an hour hand 37 and a minute hand 38 and located on a face of a casing 1 in which a driving circuit which will be hereinafter described and a printing mechanism are contained. A digital display unit 73 such as a liquid crystal display panel is located at a central portion of the analog display mechanism 4. The analog display mechanism 4 and the digital display unit 73 are normally supplied for operation thereof with an electric power from the commercial power supply.

Figure 1A:
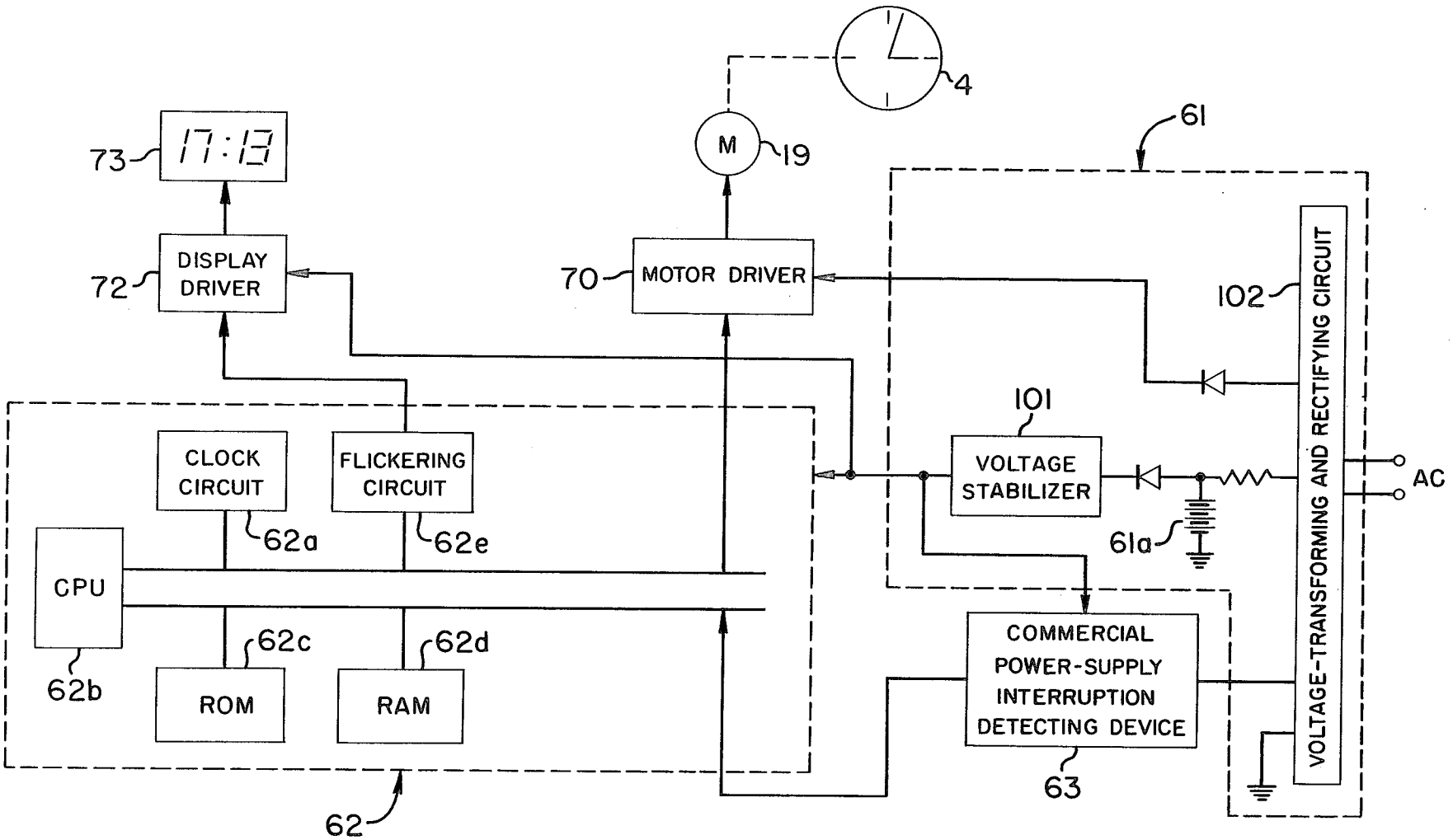
FIG. 1A is a block diagram of a system showing another embodiment of the present invention.

Referring now to FIG. 1A, there is illustrated an embodiment of a driving circuit. The driving circuit includes a power source 61, a controlling device 62 and a commercial power supply interruption detecting device 63. The power source 61 rectifies the commercial power supply into a dc power which is supplied as an operating power to the controlling device 62, the interruption detecting circuit 63, a motor driver 70 and a display driver 72, via a secondary cell 61*a* being charged in a floating state. The controlling device 62 includes a clock circuit 62*a* for generating reference time signals consisting of an hour, minute and second signal and a month and day signal, a CPU 62*b*, a ROM 62*c* in which a control program for controlling operation of the CPU 62*b* is stored, a RAM 62*d* for storing therein the time when the service interruption occurs, and a flickering circuit 62*e* for intermittently enabling the display driver 72 operative during service interruption. Thus, the controlling device 62 receives a signal from the service interruption detecting circuit 63 and feeds the clock signals to the display driver 72 and the motor driver 70. A stepping motor 19 is connected to be driven to rotate in response to a driving signal from the motor driver 70 and is connected to the analog display mechanism 4 and to printing wheels (not shown) by way of a transmission mechanism.

When the commercial power supply is applied to the power source 61 in the present embodiment, the service interruption detecting circuit 63 provides an L level signal and the power source 63 provides the the operating power. The clock circuit 62*a* delivers a month and day signal to the display driver 72 and an hour, minute and second signal to the motor driver 70. As a result, the display driver 72 drives the digital display unit 73 to indicate the date in a stationary condition while the motor driver 70 drives the stepping motor 19 to turn the hour hand 57 and the minute hand 28 and rotate the analog display mechanism 4 and the printing wheels (not shown) in accordance with the hour and minute signal, thereby to effect analog indication of the hour and minute (I in FIG. 2)A.

If a time card is inserted into the time recorder at this point of time, then the date and the time are printed at a predetermined area of the card by a printing hammer.

Figure 2A:
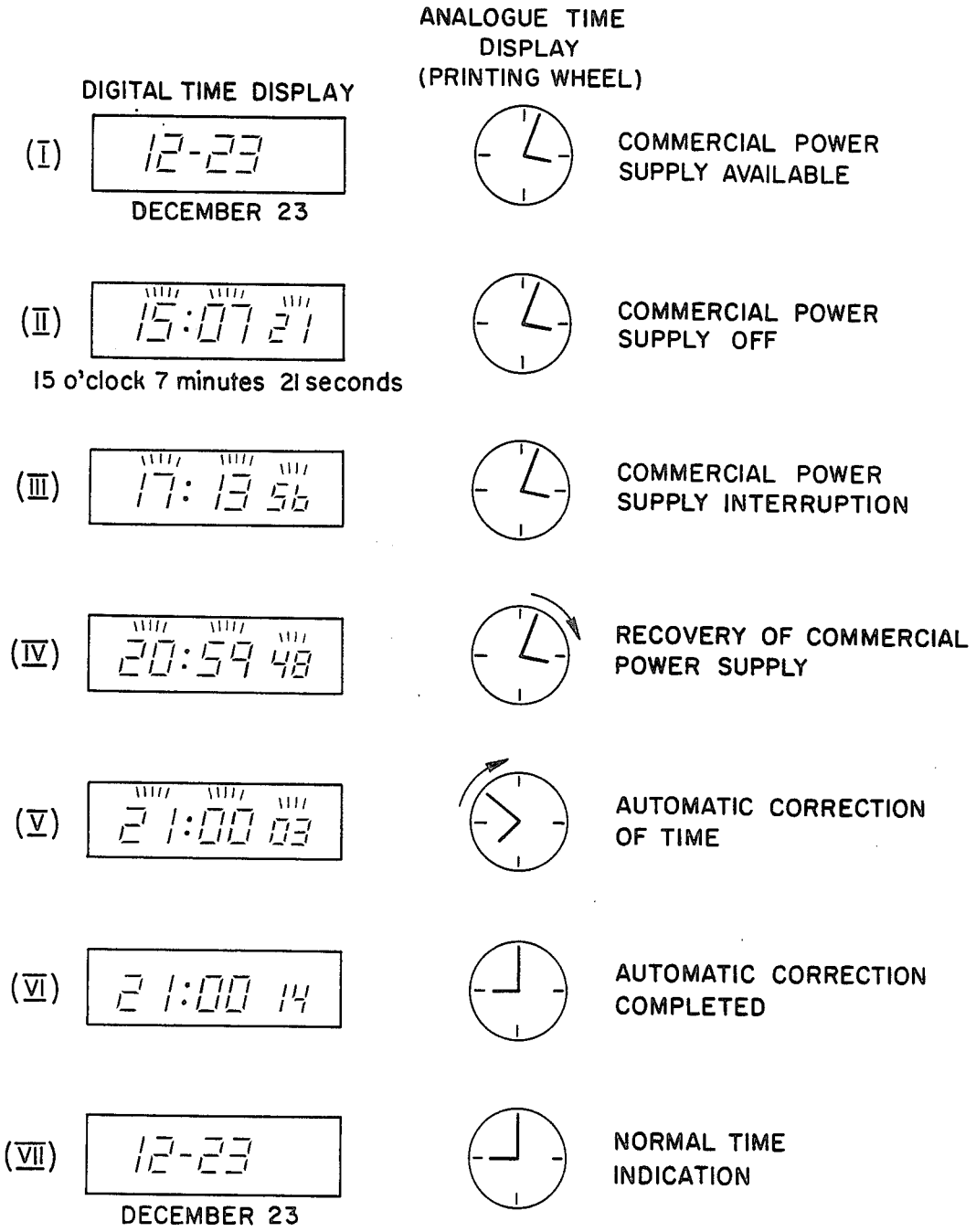
FIG. 2A is a diagrammatic representation illustrating the operation of the system of FIG. 1A.

In this condition, if the supply of the commercial power is interrupted, for example, due to service shutdown, the controlling device 62 is now supplied with power from the backup secondary battery 61*a* to maintain the operating condition. On the other hand, in response to such interruption of the commercial power supply, the service interruption detecting circuit 63 reverses its output to an H level. The CPU 62*b* now receives the H level signal and stores the month and day data and the hour, minute and second data fed from the clock circuit 62*a*, that is, the date and the time just before the starting of the service interruption, into the RAM 62*d* while the hour, minute and second signal is delivered also to the display driver 72 via the flickering circuit 62*e* thereby to change over the indication of the digital display unit 73 from the month and day display to the hour, minute and second display. As a result, the present hour, minute and second is indicated in a flickering condition on the digital display unit 73 (II in FIG. 2A). Accordingly, a user will recognize the present time accurately by observing the digital indication given in a flickering condition by the digital display unit 73 and can simultaneously recognize the service interruption. During the service interruption, the controlling device 62 including the clock circuit 62*a* is fed with power from the backup battery 61*a* to maintain the timing operation in a similar manner as before the service interruption. Accordingly, the present time is indicated on the digital display unit 73 in the flickering condition (III in FIG. 2).

In this condition, if the commercial power supply becomes available to the system again due to recovery from the service interruption, the service interruption detecting circuit 63 reverses its output and feeds an L level signal to the controlling device 62. The CPU 62*b* thus delivers pulse drive signals having a high repeat frequency to the motor driver 70 and at the same time, adds corresponding clock pulse signals data to the time the just before the starting of the service interruption stored in the RAM 62*a*. The motor 19 receives the quick drive pulse signals of the high repeat frequency and feeds the analog time display mechanism 4 and the printing wheels quickly (IV, V in FIG. 2A). Such a series of quick operations are repeated until the coincidence between a value of the service interruption starting time data corrected by the quick clock pulse signals and a present value of the clock circuit 2*a*. Thereupon, the development of the quick drive pulse signals for quick feeding is stopped, and at the same time, the flickering operation of the digital display unit 73 is stopped (VI in FIG. 2A) and the indication of the digital display unit 73 is changed over from the hour, minute and second display to the month and day display (VII in FIG. 2A). Accordingly, the indication of the time in the analog time display mechanism 4 and in the printing wheels for the day, hour and minute is automatically corrected to the present time. Due to the stopping of flickering of the digital display unit 73, a user can recognize that the power supply has been recovered and that the date and the time are indicated on the digital display unit 73 and the analog clock holds the accurate time.

It is to be noted that while in the present embodiment the time at which the supply of the commercial power is interrupted is stored in the RAM 62*d*, similar effects can naturally be obtained if otherwise a total value between a time interval from the starting of the service interruption to recovery from the service interruption and a time interval required for correction of the time, that is, the total time interval from starting of the service interruption to completion of the correction, is calculated and a number of quick pulses corresponding to the total time interval are developed.

As apparent from the foregoing description, according to the present invention, when the supply of the commercial power is interrupted, the contents of indication of a digital display unit is changed over from the month and day to the hour and minute with the flicker indication. Accordingly, such service interruption can be indicated without using an additional service interruption indicating element.

Now, the third embodiment will be described in detail in conjunction with the accompanying drawings.

FIG. 2 shows essential part of a time recorder to which the present invention is applied. The structure shown generally includes a clutch mechanism 10 connected to be driven by a stepping motor 19, a printing wheel set 20 connected to be driven by the clutch mechanism 10, a transmission mechanism 30 (FIG. 3) for transmitting rotation to a pair of hands 37, 38 by way of a minute deceleration wheel 17, a feed mechanism 40 connected to be driven by a date printing wheel 24 to stepwisely feed a card, and a printing mechanism 50 for printing the date and time on the card inserted into the time recorder.

The individual mechanisms are now described in detail. A clutch wheel shaft 11 is supported on and extends between a front side wall 1 and a rear side wall 2 and has a clutch wheel 12 loosely fitted around the shaft 11 and meshed with a pinion 19*a* which is secured to a shaft of the stepping motor 19. A minute clutch wheel 13 and a day clutch wheel 15 are loosely fitted around the clutch wheel shaft 11 and are urged in the axial direction toward the clutch wheel 12 located therebetween and thus toward each other by means of a pair of coil springs 14 interposed between the minute clutch 13 and the front side wall 1 and between the day clutch wheel 15 and the rear side wall 2, respectively.

FIG. 4 shows the clutch mechanism 10 in a fragmentary representation. The clutch wheel 12 has a minute feed cylinder 12*a* and a day feed cylinder 12*b* formed to extend integrally from opposite faces of the wheel 12. The minute and day feed cylinders 12*a*, 12*b* of the clutch wheel 12 have clutch teeth formed in opposite directions at end faces thereof. Meanwhile, the minute clutch wheel 13 and the day clutch wheel 15 have a minute feed cylinder 13*a* and a day feed cylinder 15*a* projecting on inner ends thereof, respectively. The minute and day feed cylinders 13*a*, 15*a* of the minute and day clutch wheels 13, 15 have clutch teeth formed on end faces thereof and meshed with the clutch teeth of the minute and day feed cylinders 12*a*, 12*b* of the clutch wheel 12, respectively. Accordingly, as the clutch wheel 12 makes one complete rotation in the clockwise direction in FIG. 4 for each minute, the minute clutch wheel 13 meshed with the minute feed cylinder 12*a* rotates a minute printing wheel 22 described below by one step by way of the minute deceleration wheel 17 (FIG. 2). On the other hand, as the clutch wheel 12 rotates in the counterclockwise direction in FIG. 4 at each 0 a.m., the day clutch wheel 15 meshed with the day feed cylinder 12*b* rotates a day printing wheel 24 described below by one step by way of a day deceleration wheel 18.

Figure 3B:
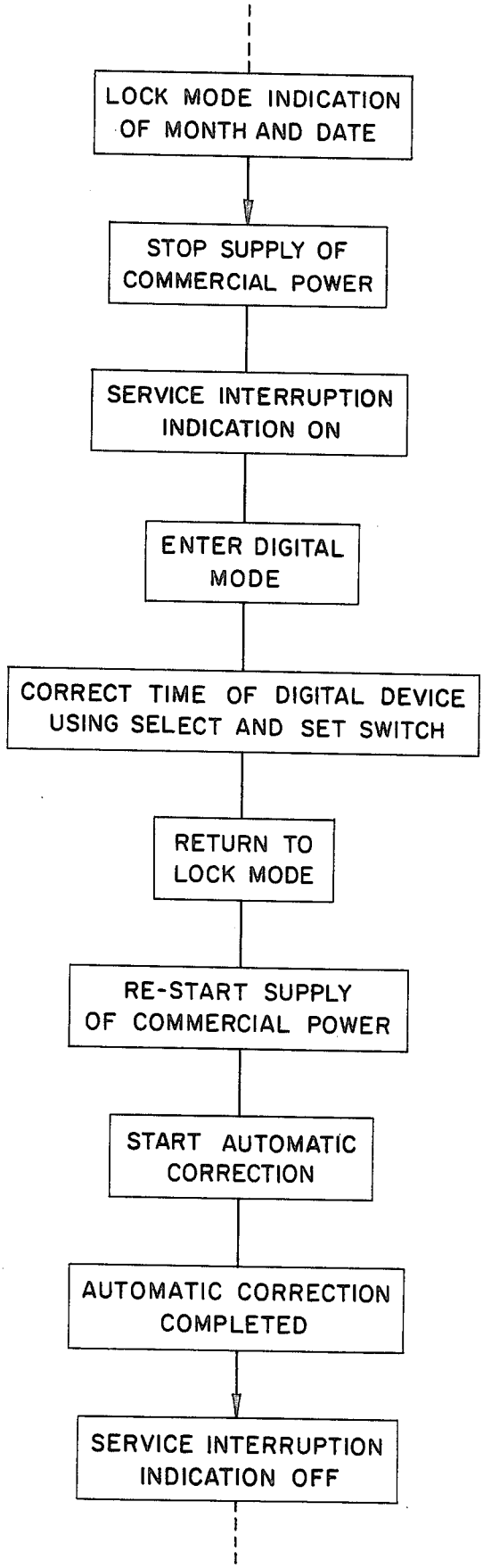
FIG. 3B is a flow chart illustrating details in step A in FIG. 2C.

Referring back top FIG. 3B, the printing wheel set 20 for printing the date and time at a required location of the time card C includes a minute printing wheel 22, a hour printing wheel 23 and a day printing wheel 24, each having the same diameter and having types of characters of 1 to 60, 1 to 24 and 1 to 31 arranged on peripheries thereof, respectively. The day printing wheel 24 which is connected through the day deceleration wheel 18 to the day clutch wheel 15 is loosely fitted around a printing wheel shaft 21 together with the hour printing wheel 23. Meanwhile, the minute printing wheel 22 which is meshed with the minute clutch wheel 13 via the minute deceleration wheel 17 is loosely fitted around a hub 23*a* of the hour printing wheel 23 and is thus located adjacent the hour and day printing wheels 23, 24.

A ratchet wheel 25 for driving the hour printing wheel 23 is connected to an end of the hub 23*a* of the hour printing wheel 23 for integral rotation therewith and has up to twenty four ratchet teeth formed on a circumferential periphery of the ratched wheel 25 and adapted to be engaged with a detent pawl 26 and a feed pawl 27 as shown in FIG. 5. The feed pawl 27 is supported for rocking movement at an end 28*b* of an arm of a feed lever 28 supported for pivotal movement on a fixed shaft 29. The feed lever 28 has a cam follower 28*a* located at an end of the other arm of the lever 28 and slidably engaged with an outer periphery of a snail-shaped peripheral cam 22*a* integral with the minute printing wheel 22 so that the lever 28 can be rocked by the peripheral cam 22*a* to feed the ratchet wheel 25 once for an hour to rotate the integral hour printing wheel 23 by one step in the clockwise direction in FIG. 5.

On the other hand, a clock top plate 31 is disposed in a plane parallel to the plane of FIG. 2, that is, perpendicular to the front side wall 1 and the rear side wall 2. FIG. 3 shows the transmission mechanism 30 on the top plate 31. A dial plate 32 is located in a spaced relationship in front of the top plate 31. A transmission wheel 35 is located between the top plate 31 and the dial plate 32 and is meshed with a clock wheel 33 and a minute time pinion 34. The transmission wheel 35 is coupled via a pinion 36*a* to an intermediate transmission wheel 36 which is meshed with a crown gear 17*a* integral with the minute deceleration wheel 17 (FIG. 2) so that the rotation of the minute deceleration wheel 17 can be transmitted to an hour hand 37 and a minute hand 38 with the ratio of 1:12.

Now, the step feed mechanism 40 to which a driving force is provided from the day printing wheel 24 will be described. A first step feed wheel 41 of the step feed mechanism 40 is fitted around the printing wheel shaft 21 adjacent the day printing wheel 24. The first step feed wheel 41 has a pair of pawl pieces 41*a* each in the form of a cantilever formed on a face of the wheel 41 by stamping. The pawl pieces 41 of the first step feed wheel 41 are engaged at free ends thereof with inner ratchet teetch 24*a* provided on a side face of the day printing wheel 24 so that each time the day printing wheel 24 rotates in a direction indicated by an arrow mark in the drawing once for a day, the first step feed wheel 41 is moved stepwise in the same direction with the day printing wheel 24.

Figure 4B:
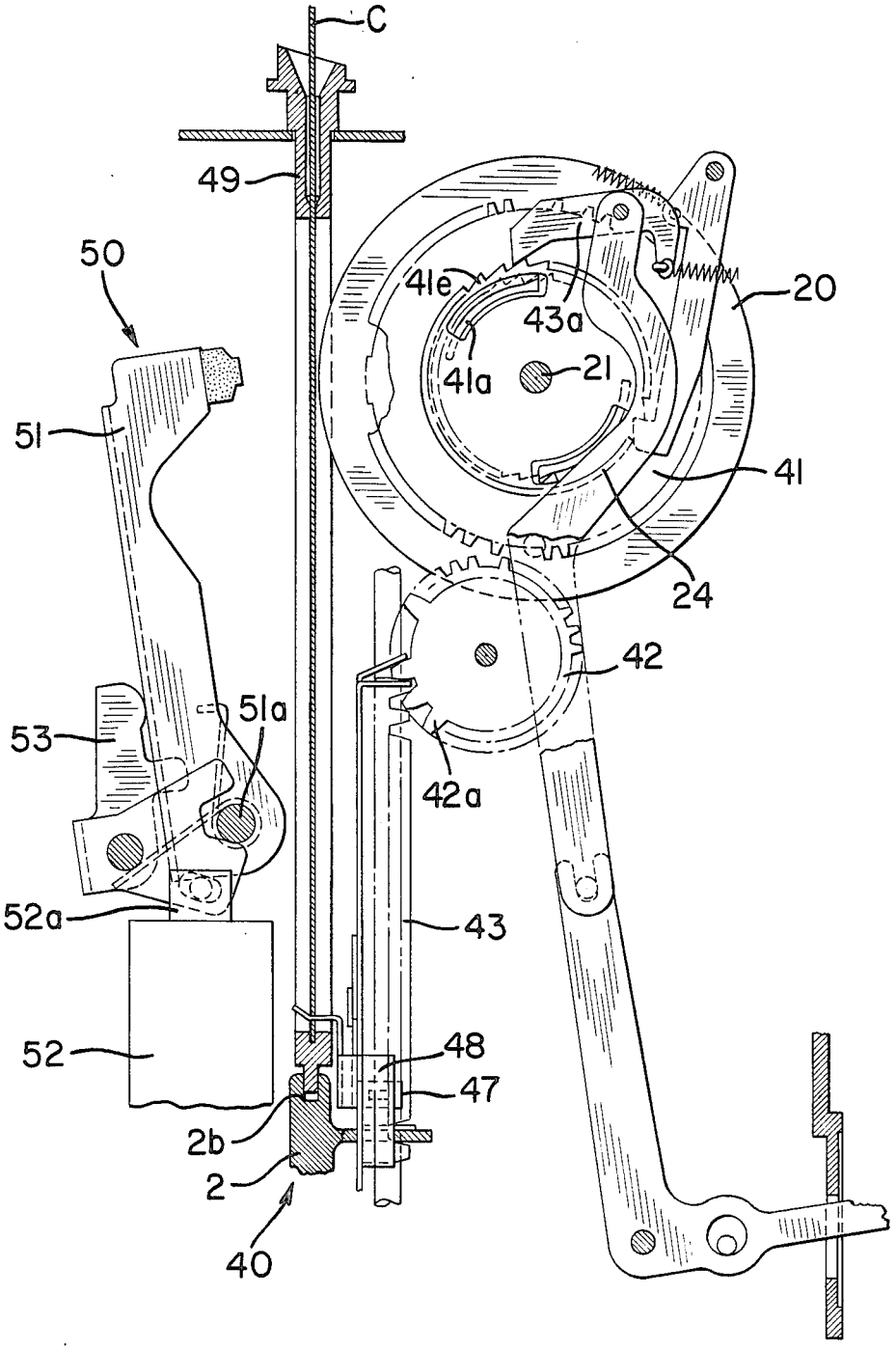
FIG. 4B is a side elevational view of a printing mechanism.

By the way, FIG. 4B shows the printing mechanism 50 located at a rear portion within a body of the apparatus. A card guide 49 for guiding a card C inserted into the apparatus body from the top portion thereof is located adjacent a rear face of the printing wheel set 20 and is mounted in a guide groove 2*b* of the side wall 2 such that the card guide 49 can move in the vertical direction relative to a circumferential face of the printing wheel set 20. A hammer 51 is located behind the card guide 49 and is mounted for pivotal movement around a pin 51*a* with an end thereof positioned in the neighborhood of a portion of the circumferential face of the printing wheel set 20 at which the card C is contacted with the printing wheel set 20. The hammer 51 is connected, via a rocking lever 53, to a plunger 52*a* of a solenoid 52, to be driven by the solenoid 52 which operates in response to a card detecting switch 48.

Now, a driving circuit for controlling operation of the mechanisms described above will be described.

Figure 1B:
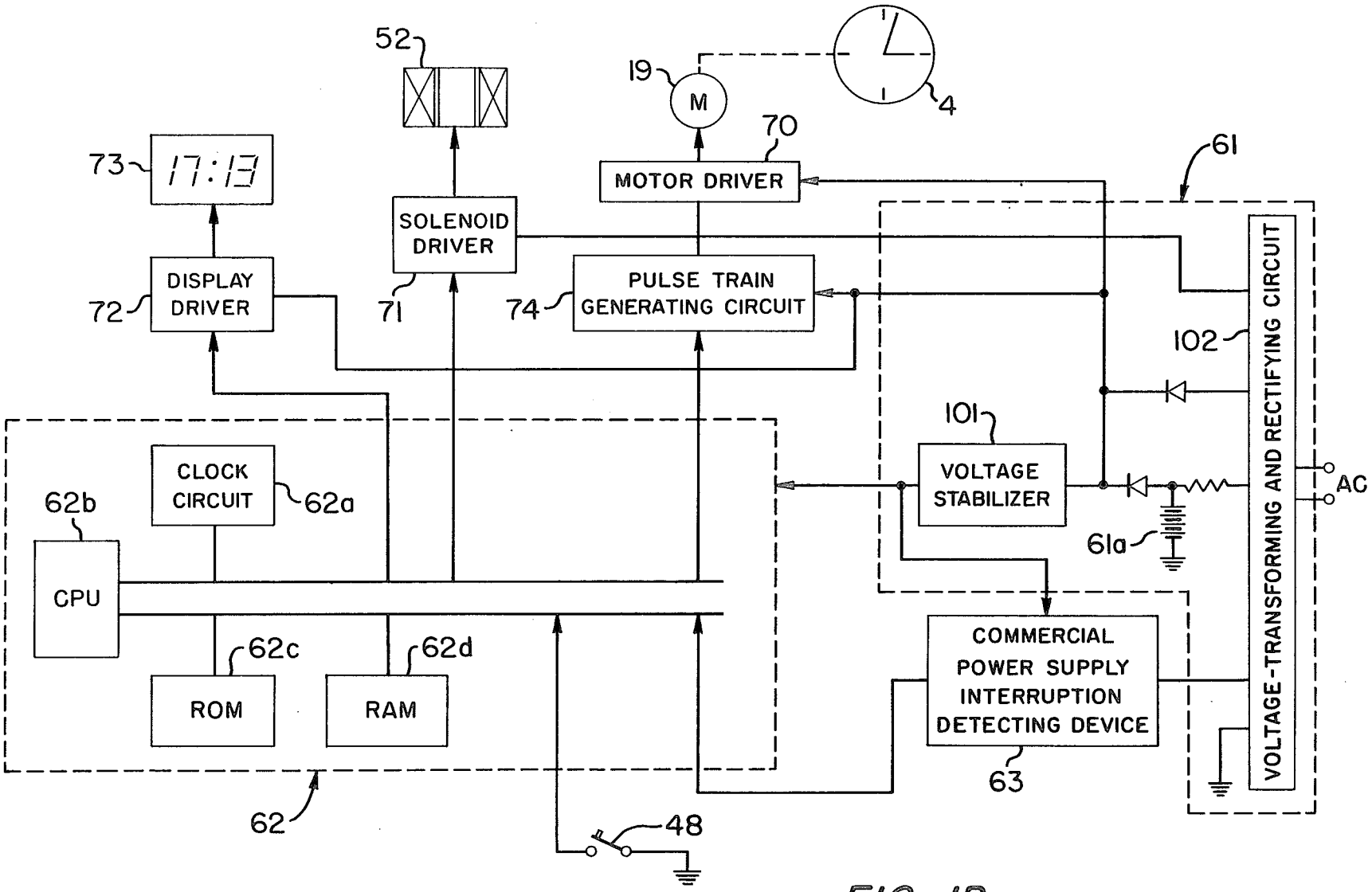
FIG. 1B ia a block diagram of an apparatus showing a further embodiment of the present invention.

FIG. 1B illustrates an embodiment of a driving circuit for controlling operation of the apparatus described above. The driving circuit includes a power source device 61 which rectifies the commercial power supply into a dc power and supplies the dc power to a solenoid driver 71 and, via a secondary cell 61*a* being charged in a floating state, to a controlling device 62, a motor driver 70, a display driver 72 and a pulse generating circuit 74. The controlling device 62 includes a clock circuit 62*a* for generating a reference timing signal, a CPU 62*b*, a ROM 62*c* in which a control program for controlling operation of the CPU 62*b* is stored, and a RAM 62*d* for storing therein the time upon which the service interruption is stated. The controlling device 62 is connected to receive signals from the card detecting switch 48 and the service interruption detecting circuit 63 and to deliver a time signal to the display driver 72 and the motor driver 70 and a printing instruction signal to the solenoid driver 71. The pulse train generating circuit 74 normally develops, in synchronism with a signal delivered each minute from the clock circuit 62*a*, a train of driving pulses required in number to rotate the stepping motor 19 one full rotation, but when the data is to be changed, the pulse generating circuit develops a train of driving pulses in the opposite phase having a lower repeat frequency.

Operation of the apparatus having such a construction as described above will now be described with reference to a timing chart shown in FIG. 2B.

While the commercial power supply is held connected to the power source device 61, an L level signal is developed from the service interruption detecting circuit 63 and hence power from the commercial power supply is supplied to the individual parts of the apparatus. Each time a clock minute signal is coupld to the pulse generating circuit 74 for each minute from the clock circuit 62*a*, a number of pulses required to cause the stepping motor 19 to rotate one complete rotation are developed from the pulse generating circuit 74. Consequently, the clutch wheel 12 is rotated in the clockwise direction in the drawing via the pinion 19*a* to rotate the minute printing wheel 22 a step corresponding to a pitch between character types thereon via the minute clutch wheel 13*c* and the minute deceleration wheel 17. Thus, upon subsequent rotation after the type of character "59" on a shoulder of the minute printing wheel 22 has come to a position opposing to the end of the hammer 51, the cam follower 28*a* is dropped from the lobe of the peripheral face of the cam 22*a* rotating in the integral relationship with the minute printing wheel 22 to cause the feed lever 28 to rock in a direction to feed the ratchet wheel 25 by one tooth pitch by means of the feed pawl 27 at the end 28*b* of the feed lever 28 thereby to integrally rotate the hour printing wheel 23 by one hour pitch.

On the other hand, the transmission wheel 36 meshed with the crown gear 17*a* of the minute clutch wheel 13 transmits the rotation of the minute clutch wheel 13 to the transmission wheel 35 to advance the minute hand 38 and the hour hand 37 by respective pitches corresponding to one minute and one hour.

If the time comes to 0:00 a.m. in this manner, driving pulses from the pulse generating circuit 74 is developed directly after completion of the operation described above so that the driving pulses in a reverse phase but having a lower repeat frequency than that of driving pusles in a normal phase are fed to the motor 19.

Consequently, the stepping motor 19 is rotated at a lower speed but in the reverse direction. Accordingly, the day clutch wheel 15 which has been stationary is now driven to rotate by the clutch teeth provided on the day feed cylinder 12*b* of the clutch wheel 12 to advance the day printing wheel 24 by one day pitch via the day deceleration wheel 18. On the other hand, as the day printing wheel 24 rotates, the first step feed wheel 41 is rotated by way of the pawl pieces 41*a* engaged with the ratchet inner teeth 24*a* of the day printing wheel 24 so that a rack rod 43 will be pulled up by one tooth pitch by a rack feed gear 42*a* of the second step feed wheel 42 meshed with the first step feed wheel 41 as shown in FIG. 2. In this instance, as the rack rod 43 is pulled up, a high load is applied to the stepping motor 19. However, since the stepping motor 19 is then operating in response to the driving pulses of the low repeat frequency as described hereinabove, the output torque is high enough to pull up the rack rod 43 without causing disengagement of the rack rod 43 from the rack feed gear 42*a*.

Figure 2B:
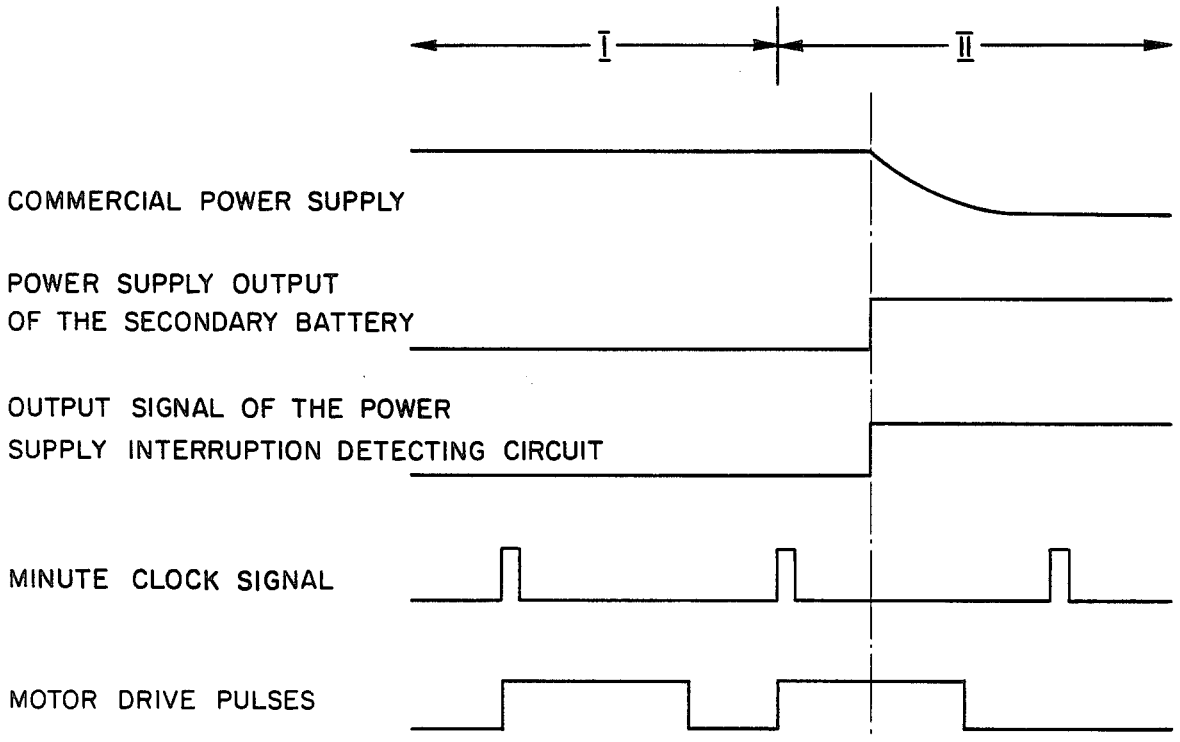
FIG. 2B is a timing chart showing the operation of the apparatus of FIG. 1B.

After completion of the day changing over operation in this manner, the driving pulses in the normal phase are developed from the pulse generating circuit 74 in response to the clock signal from the clock circuit 62*a* for each minute to rotate the stepping motor 19 forwardly a shown the left hand I of FIG. 2B.

By the way, if the supply of the commercial power is interrupted due to the service shutdown or by some other reasons during rotation of the minute printing wheel 22 toward a next character type after the stepping motor 19 has started its rotation in response to a clock signal for each minute from the clock circuit 62*a*, the output signal of the service interruption detecting circuit 63 is reversed from the L level to the H level. As a result, the solenoid driver 71 is rendered inoperative while power from the auxiliary power source 61*a* is now supplied to the controlling device 62, motor driver 70, display driver 72, and pulse generating circuit 74. Thus, the motor driver 70 continues, based on the power from the auxiliary power source 70, to power-amplify and supply driving signals from the pulse train generating circuit 74 to supply the same to the stepping motor 19. In this instance, the motor driver 70 supplies continuously after the preceding series of driving pulses developed before the service interruption, a number of driving pulses corresponding to a difference between the number of driving pulses required for one complete rotation of the motor 19 and the number of driving pulses in the preceding series so that the stepping motor 19 may be rotated one complete rotation to feed the printing wheel set 20 by one character pitch. After completion of the feeding by one character pitch, the CPU 62*b* renders the motor driver 70 inoperative to prevent useless consumption of power of the auxiliary power source 61*a*. Thus, the printing wheel 22 is stopped after the character type thereon has been placed in a correct position opposing to the printing hammer 51. Accordingly, upon recovery of the commercial power supply, the printing wheel 22 can be rotated from the correct position in synchronism with driving pulses.

On the other hand, during the service interruption, those circuit elements which are relatively low in power consumption, such as the controlling device and the display driver, receive supply of power from the auxiliary power source to continue their operating conditions and thus a clocking operation. It is to be noted that while the printing wheels have been described in the present embodiment, naturally the other mechanisms can such as the step feed mechanism wait for recovery from service interruption after they have been placed in their respective correct positions.

As apparent from the foregoing description, according to the present invention, when the supply of the commercial power is interrupted during rotation of a motor which drives a wheel train and a ratchet mechanism, power supply is changed over to an auxiliary power source to fully drive the wheel train and the ratchet mechanism for one cycle. Accordingly, a transmission mechanism which is connected to the motor can be stopped in a meshed condition, and hence an angular displacement between the motor and the printing wheel upon re-starting of the apparatus can be eliminated, thereby assuring accurate printing.

Now, the fourth embodiment will be described in detail in conjunction with the accompanying drawings.

FIG. 2 shows essential part of a time recorder to which the present invention is applied. The structure shown generally includes a clutch mechanism 10 connected to be driven by a stepping motor 19, a printing wheel set 20 connected to be driven by the clutch mechanism 10, a transmission mechanism 30 (FIG. 3) for transmitting the rotation of a motor to a pair of hands 37, 38 by way of a minute deceleration wheel 17, a feed mechanism 40 connected to be driven by a date printing wheel 24 to stepwisely feed a card, and a printing mechanism 50 for printing the date and time on a card inserted into the time recorder.

The individual mechanisms are now described in detail. A clutch wheel shaft 11 is supported on and extends between a front side wall 1 and a rear side wall 2 and has a clutch wheel 12 loosely fitted thereon and meshed with a pinion 19*a* which is secured to a shaft of the stepping motor 19. A minute clutch wheel 13 and a day clutch wheel 15 are loosely fitted around the clutch wheel shaft 11 and are urged in an axial direction toward the clutch wheel 12 located therebetween and thus toward each other by means of a pair of coil springs 14 interposed between the minute clutch 13 and the front side wall 1 and between the day clutch wheel 15 and the rear side wall 2, respectively.

FIG. 4 shows the clutch mechanism 10 in a fragmentary representation. The clutch wheel 12 has a minute feed cylinder 12*a* and a day feed cylinder 12*b* formed to extend integrally from opposite faces thereof. The minute and day feed cylinders 12*a*, 12*b* of the clutch wheel 12 have clutch teeth formed in opposite directions at end faces thereof. Meanwhile, the minute clutch wheel 13 and the day clutch wheel 15 have a minute feed cylinder 13*a* and a day feed cylinder 15*a* formed projectingly on inner ends thereof, respectively. The minute and day feed cylinders 13*a*, 15*a* of the minute and day clutch wheels 13, 15 have clutch teeth formed on end faces thereof and meshed with the clutch teeth of the minute and day feed cylinders 12*a*, 12*b* of the clutch wheel 12, respectively. Accordingly, as the clutch wheel 12 makes one complete rotation in the clockwise direction in FIG. 5 for each minute, the minute clutch wheel 13 meshed with the minute feed cylinder 12*a* rotates a minute printing wheel 22 described below by one step by way of the minute deceleration wheel 17 (FIG. 2). On the other hand, as the clutch wheel 12 rotates in the counterclockwise direction in FIG. 4 at each 0 a.m., the day clutch wheel 15 meshed with the day feed cylinder 12*b* rotates a day printing wheel 24 described below by one step by way of a day deceleration wheel 18.

Referring back to FIG. 2, the printing wheel set 20 for printing the date and time at a required location of a time card C includes a minute printing wheel 22, a hour printing wheel 23 and a day printing wheel 24 each having the same diameter and having types of characters of 1 to 60, 1 to 24 and 1 to 31 arranged on peripheries thereof, respectively. The day printing wheel 24 which is connected through the day deceleration wheel 18 to the day clutch wheel 15 is loosely fitted around a printing wheel shaft 21 together with the hour printing wheel 23. Meanwhile, the minute printing wheel 22 which is meshed with the minute clutch wheel 13 via the minute deceleration wheel 17 is loosely fitted around a hub 23*a* of the hour printing wheel 23 and is thus located adjacent the hour and day printing wheels 23, 24.

A ratchet wheel 25 for driving the hour printing wheel 23 is connected to an end of the hub 23*a* of the hour printing wheel 23 for integral rotation therewith and has up to twenty four ratchet teeth formed on a circumferential periphery of the latchet wheel 25 and adapted to be engaged with a detent pawl 26 and a feed pawl 27 as shown in FIG. 5. The feed pawl 27 is supported for rocking movement at an end 28*b* of an arm of a feed lever 28 supported for pivotal movement on a fixed shaft 29. The feed lever 28 has a cam follower 28*a* located at an end of the other arm thereof and slidably engaged with an outer periphery of a snail-shaped peripheral cam 22*a* integral with the minute printing wheel 22 so that the feed lever 28 can be rocked by the peripheral cam 22*a* to feed the ratchet wheel 24 once for an hour to rotate the integral hour printing wheel 23 by one step in the clockwise direction in FIG. 5.

On the other hand, a clock top plate 31 is disposed in a plane parallel to the plane of FIG. 2, that is, perpendicular to the front side wall 1 and the rear side wall 2. FIG. 3 shows the transmission mechanism 30 on the top plate 31. A dial plate 32 is located in a spaced relationship in front of the top plate 31. A transmission wheel 35 is located between the top plate 31 and the dial plate 32 and is meshed with a clock wheel 33 and a minute time pinion 34. The transmission wheel 35 is coupled via a pinion 36*a* to an intermediate transmission wheel 36 which is meshed with a crown gear 17*a* integral with the minute deceleration wheel 17 (FIG. 2) so that the rotation of the minute deceleration wheel can be transmitted to an hour hand 37 and a minute hand 38 with the ratio of 1:12.

Now, the step feed mechanism 40 to which a driving force is provided from the day printing wheel 24 will be described (FIG. 4B). A first step feed wheel 41 of the step feed mechanism 40 is fitted on the printing wheel shaft 21 adjacent the day printing wheel 24. The first step feed wheel 41 has a pair of pawl pieces 41*a* each in the form of a cantilever formed on a face of the wheel 41 by stamping. The pawl pieces 41*a* of the first step feed wheel 41 are engaged at free ends thereof with inner ratchet teeth 24*a* provided on a side face of the day printing wheel 24 so that each time the day printing wheel 24 rotates in a direction indicated by an arrow mark in the drawing once for a day, the first step feed wheel 41 is moved stepwise in the same direction with the day printing wheel 24.

By the way, FIG. 4B shows the printing mechanism 50 located at a rear portion within a body 5 of the apparatus. A card guide 49 for guiding a card C inserted into the apparatus body 5 from above is located adjacent a rear face of the printing wheel set 20 and is mounted in a guide groove 2*b* of the side wall 2 such that the card C can move in the vertical direction relative to circumferential face of the printing wheel set 20. A hammer 51 is located behind the card guide 49 and is mounted for pivotal movement around a pin 51*a* with an end thereof positioned in the neighborhood of a portion of the circumferential face of the printing wheel set 20 at which the card C is contacted with printing wheel set 20. The hammer 51 is connected, via a rocking lever 53, to a plunger 52*a* of a solenoid 52 to be driven by the solenoid 52 which operates in response to a card detecting switch 48 which is operated by a switch lever 47.

Figure 1C:
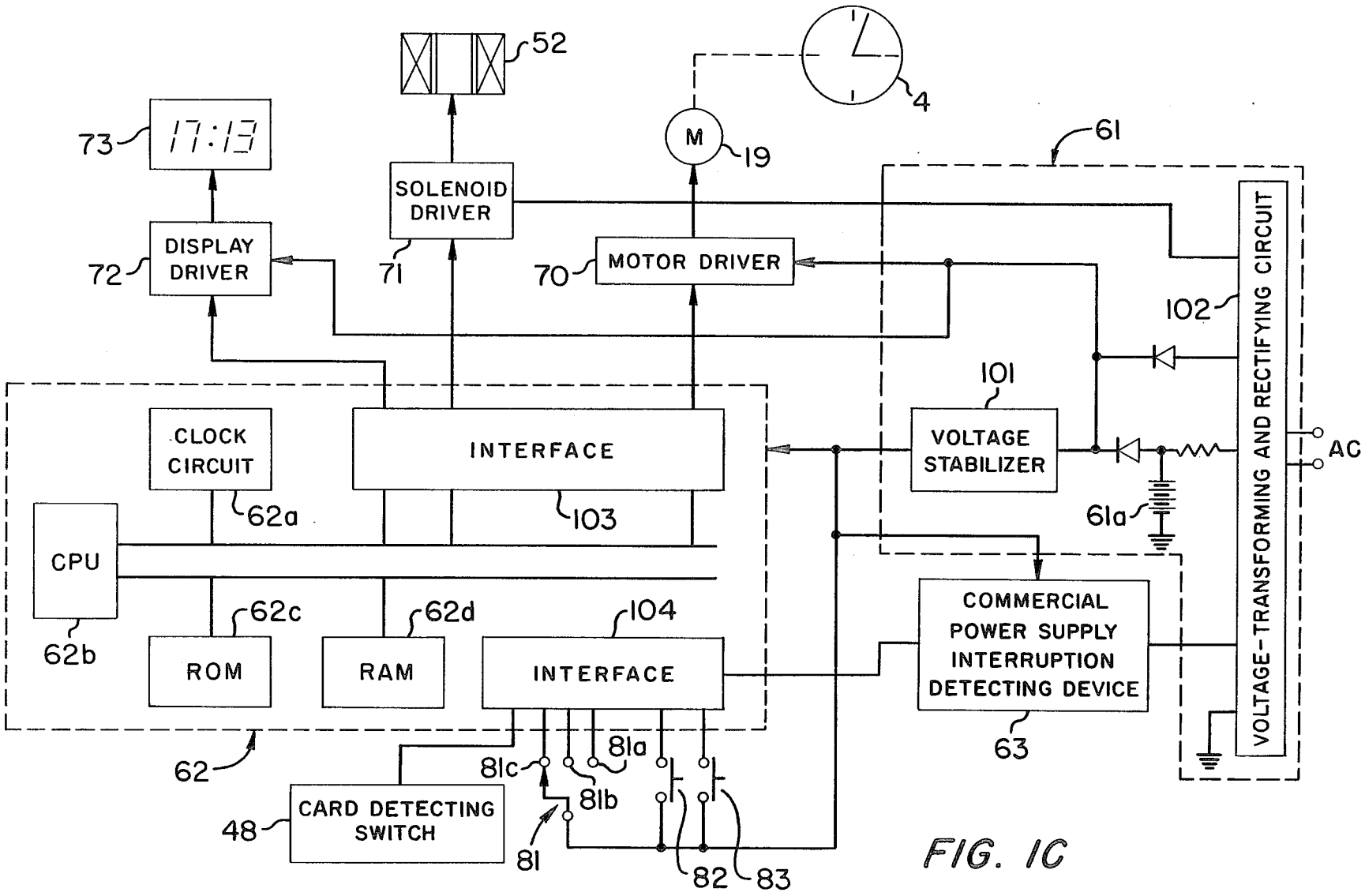
FIG. 1C is a block diagram of an apparatus showing a still further embodiment of the present invention.

FIG. 1C illustrates an embodiment of a driving circuit which includes a power source device 61, a controlling device 62, and a service interruption detecting device 63. The power source device 61 rectifies the commercial power supply into a dc power and supplies a driving power to a solenoid driver 71 and an operating power, via a secondary cell 61*a* connected in a floating state to the controlling device 62, a motor driver 70, and a display driver 72. The controlling device 62 includes a clock circuit 62*a* for generating a reference clock signal, a CPU 62*b*, a ROM 62*c* in which a control program for controlling operation of the CPU 62*b* is stored, a RAM 62*d* for storing therein the time upon which the service interruption is started, and interfaces 103 and 104. The controlling device 62 is connected to receive clock signals from the clock circuit 62*a* to operate a digital display unit 73 (FIG. 5A) via the display driver 72 and to drive the stepping motor 19 via the motor driver 70 to drive the minute and hour printing wheels 22, 23, the day printing wheel 24 and the card stage positioning mechanism 40 all of which are connected to the stepping motor 19 and constitute the analog display mechanism 4 and a time recording mechanism. Further, the controlling device 62 enables correction of the time at the clock circuit 62*a* in response to a signal from a time correcting device according to whether or not the supply of the commercial power is available. Besides, the controlling device 62 drives the solenoid driver 71 in response to a signal from the card detection swtich 48 and compensates for service interruption in response to a signal from the service interruption detecting circuit 63.

The aforementioned correcting device includes a mode switch 81 composed of a three position switch, a select switch 82 composed of a push button switch, and a set switch 83. The mode switch 81 is connected to a signal source not shown and can select three modes including an analog mode, a digital mode and a lock mode.

Figure 2C:
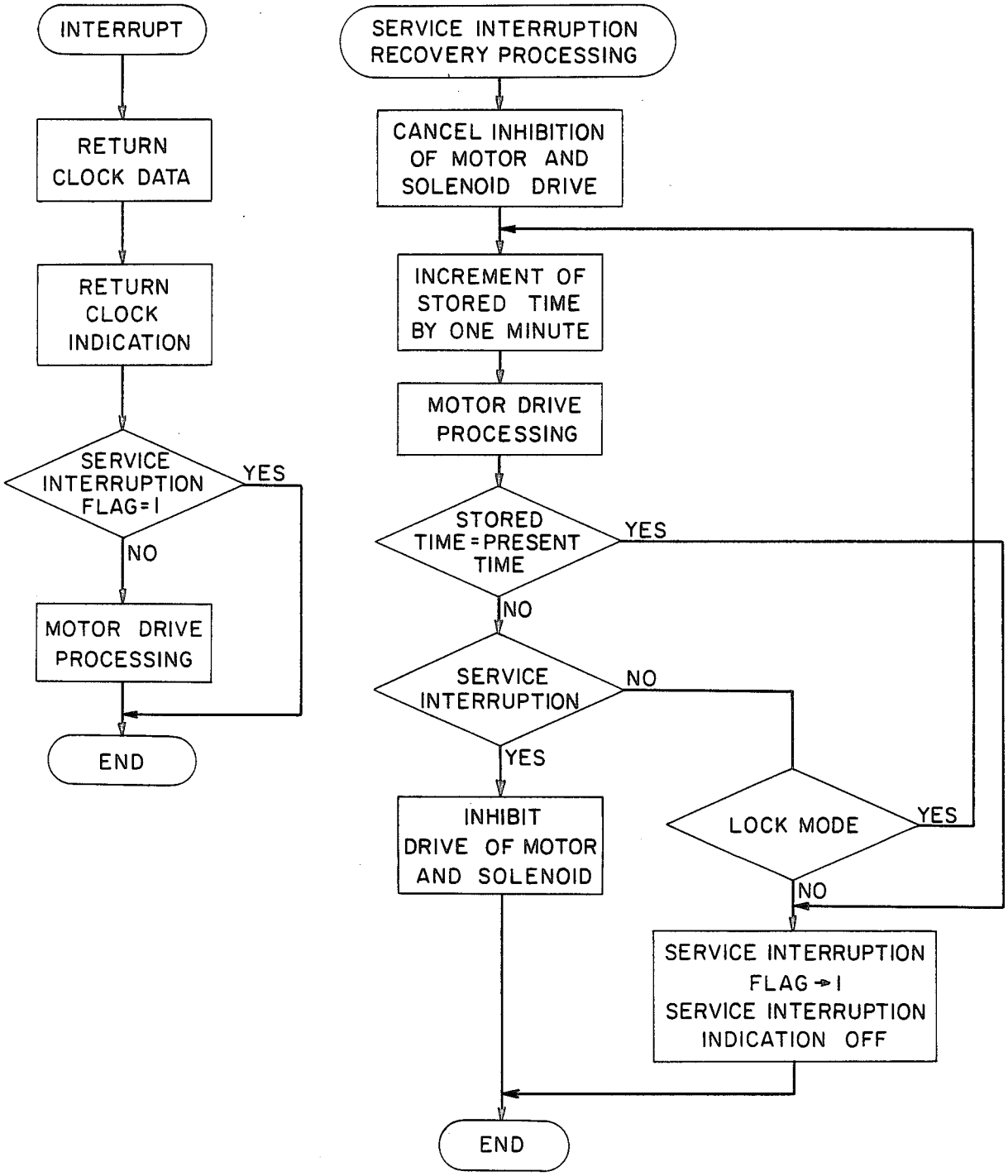
FIGS. 2C and 2D are flow charts illustrating the operation of the apparatus of FIG. 1C.
Figure 2D:
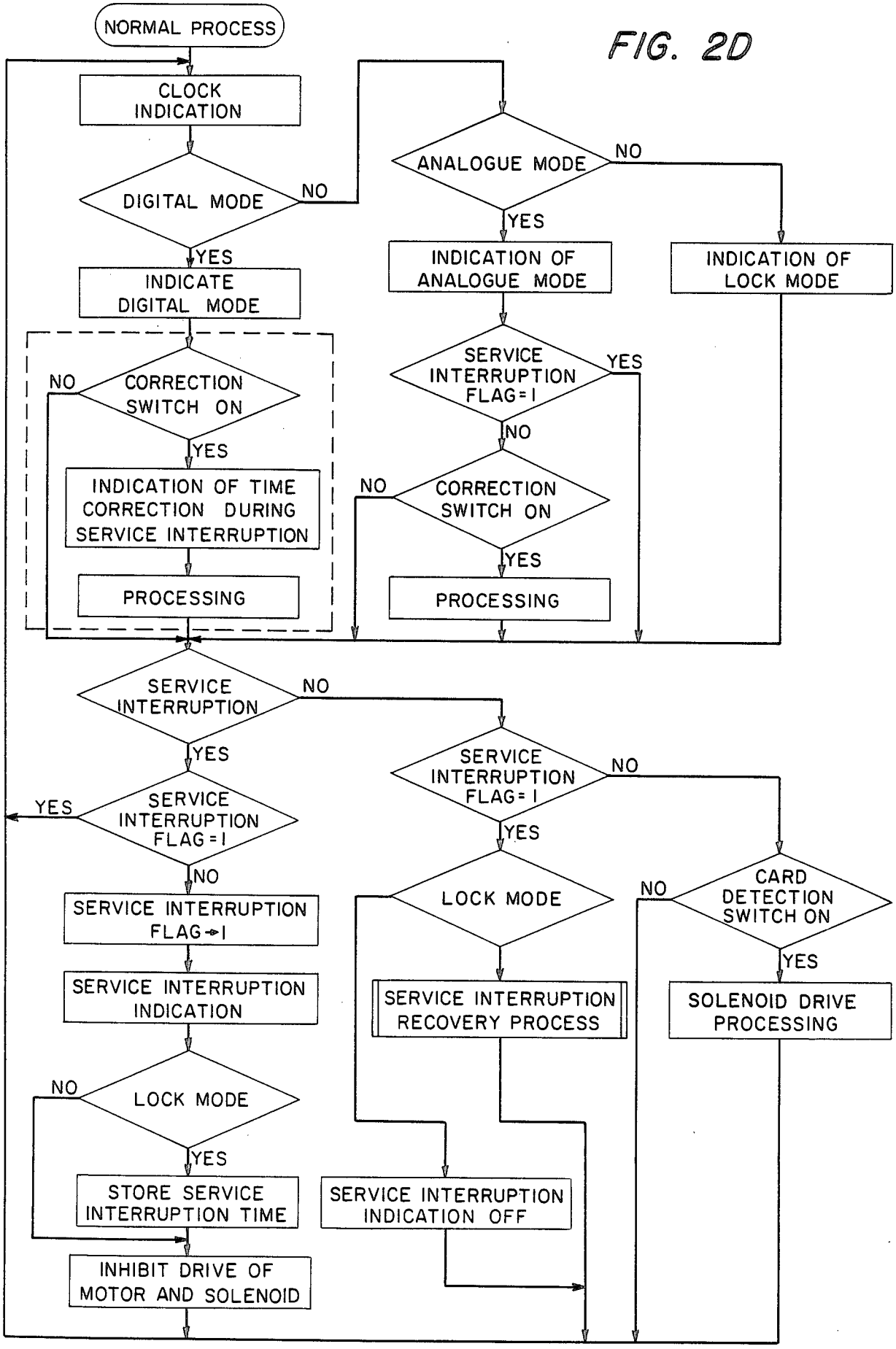

Now, normal operation of the apparatus having such a construction as described above will be described with reference to a flow chart shown in FIGS. 2C and 2D.

Figure 4C:
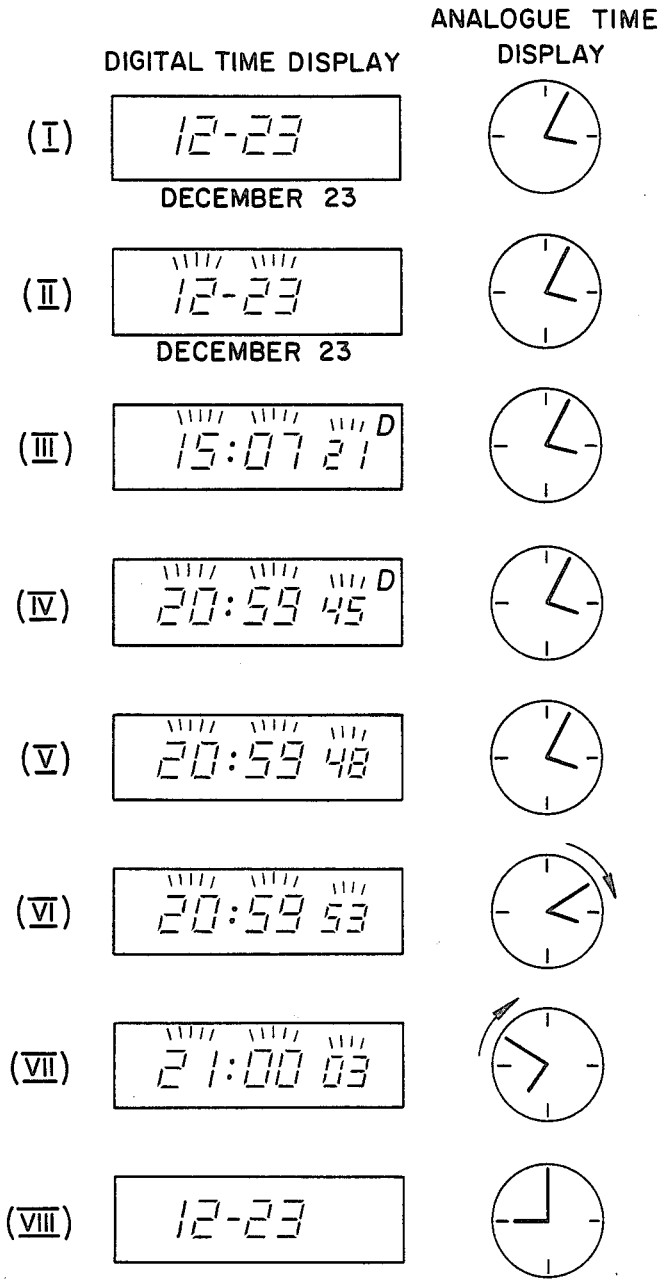
FIG. 4C is a diagrammatic representation showing the operation of the apparatus of FIG. 1C.

In the normal operation, the mode swtich 81 is positioned to select the lock mode, and thus the digital display unit 73 indicates the month and day while the analog display mechanism 4 and the printing wheel set 20 indicates the time (I in FIG. 4C). In this condition, if a card is inserted into the time recorder, the CPU 62*b* receives a signal from the card detection switch 48 and renders the solenoid driver 71 operative to drive the solenoid 52 to cause the printing hammer 51 to print the date and time at a predetermined location of the card.

In this condition, if the commercial power supply is interrupted due to service shutdown or by some other reasons, the controlling device 62 now receives supply of power from the secondary cell 61*a* for back up to maintain the operating condition thereof while the service interruption detecting circuit 63 reverses its output to the an H level in response to interruption of the supply of the commercial power. Upon reception of the H level signal, the CPU 62*b* transfers the time of the clock circuit 62*a*, that is, the time when the service interruption starts, into the RAM 62*d* while the CPU 626 causes the digital display 73 to flicker its display to indicate that the power supply is interrupted now (II in FIG. 4C). Simultaneously, the CPU 62*b* inhibits delivery of driving signals to the solenoid driver 71 and the motor driver 70. Accordingly, even if a clock signal or a printing instruction signal is developed from the controlling device 62, the motor driver 70 and the solenoid driver 71 hold their inoperative conditions to prevent useless consumption of power of the back-up secondary cell 61*a*. On the other hand, the controlling device 62 including the clock circuit 62*a* is supplied with the power from the cell 61*a* of the secondary power source device 61 to continue the clocking operation thereof in a similar manner as before the service interruption.

In this condition, if the commercial power supply becomes available again due to recovery from the service interruption, the service interruption detecting circuit 63 reverses its output and now feeds an L level signal to the controlling device 62. Consequently, the CPU 2*b* cancels the operation inhibiting condition of the motor driver 70 and feeds quick clock pulse signals having a repeat frequency higher than the normal clock signals to the motor driver 70 with reference to the service interruption starting time stored in the RAM 62*d*. The motor 19 receives the quick clock pulse signals having such a higher repeat frequency and quickly feeds the analog time display mechanism 4 and the printing wheels 20. Such a series of operations as described above are repeated until the time indication of the analogue time display mechanism 4 signals coincides with the present time of the clock circuit 62*a* whereupon development of the pulse signals for quick feeding is stopped and at the same time the solenoid driver 71 which has been in a stopped condition is now enabled for operaton. Accordingly, the time indications by the analog time display mechanism 4 and the printing wheels 20 for the day, hour and minute are automatically corrected to the present time.

Now, operation for the service interruption recovery processing for shipment from a factory or for demonstration will be described with reference to a flow chart shown in FIG. 3B.

A power supply switch not shown is first switched off to momentarily interrupt the supply of the commercial power. Consequently, the indication of the date by the digital display 73 flickers to represent such service interruption (II in FIG. 4C). In this condition, if the mode switch 81 of the correcting device is slid to a contact 81*b* to select the digital mode, the hour, minute and second are indicated in a flickering manner on the digital display unit 73 while at the same time a character "D" is indicated at a corner of the digital display unit 73 to indicate that the mode switch 81 is set to the digital mode (III in FIG. 4C). Then, the select switch 82 and the set switch 83 are operated to change or correct the time at the clock circuit 62*a* to produce a difference in time between the time at the clock circuit 62*a* and the time indicated by the analog display mechanism 4 and/or the printing wheel set 20 (IV in FIG. 4C). After completion of the setting of a predetermined difference in time, the mode switch 81 is slid back to a contact 81*a* to select the lock mode again. As a result, the indication of the character "D" disappears to indicate that the lock mode is selected (V in FIG. 4C).

Thus, after completion of entry of all data for demonstration, if the power switch is turned on to allow the supply of the commercial power again, the service interruption detecting circuit 63 reverses its output and now delivers an L level signal to the controlling device 62. The CPU 62b thus cancels the operation inhibiting condition of the motor driver 70 and feeds quick clock pulse signals to the motor driver 70 and adds them to the service interruption starting time data stored in the RAM 62d. The motor 19 thus receives the pulse signals having a higher repeat frequency and quickly feeds the analog time display mechanism 4 and the printing wheels 20 (VI, VII in FIG. 4C). Such a series of operations as described above are repeated until a value of the service interruption starting time added by the pulse signals coincides with a value of the clock circuit 62a, whereupon development of the pulse signals for quick feeding is stopped. Accordingly, the time indications by the analog time display mechanism 4 and the printing wheels 20 for the day, hour and minute are automatically corrected to the present time, and at the same time, the digital display unit 73 is changed over from the flickering indication of the time to stationary indication of the date, thereby notifying an examiner or an inspector that automatic correction after service interruption has ended (VIII in FIG. 4C).

As apparent from the foregoing description, according to the present invention, correction in a digital mode is possible when the supply of the commercial power is interrupted. Accordingly, without waiting the lapse of an actual time, an arbitrary difference in time can be set between a printing wheel and a time reference, and hence inspection of an automatic correcting function for the service interruption and demonstration can be accomplished in a very short period of time.

What is claimed is:

1. A time recorder powered in use by a commercial power supply, comprising: a digital display device for indicating the present time in response to a time signal; an analog display device including hour and minute hands; a time printing mechanism including a printing wheel; a motor; a transmission mechanism driven by the motor for driving said analog display device and said time printing mechanism; a motor driving circuit operated in response to the time signal normally by the commercial power supply to rotate the motor; a controlling circuit for controlling said digital display device, analog display device and time printing mechanism; an auxiliary power source for supplying a power to said digital display device and said controlling circuit during service interruption of the commercial power supply; a service interruption detecting circuit for detecting the service interruption of the commercial power supply so that upon the service interruption, said analog display device and said time printing mechanism are stopped by the controlling circuit; and a memory for storing the time at which the service interruption starts or a time interval during which the service interruption has continued so that, after recovery of the commercial power supply, said analog display device and said time printing mechanism are automatically corrected by the controlling circuit in accordance with the stored time or time interval in order for time indication thereof to coincide with the present time indicated by said digital display device.

2. An analog and digital clock powered in use by a commercial power supply, comprising: a clock circuit for generating a time signal; an analog display mechanism including an hour hand and a minute hand; a motor connected to the analog display mechanism and rotated in response to the time signal from said clock circuit for driving the analog display mechanism; a digital display mechanism for receiving the time signal to selectively indicate time data and normal date data; a service interruption detecting circuit for detecting service interruption of the commercial power supply and producing a corresponding detection signal; a controlling circuit for receiving the detection signal from said service interruption detecting circuit to switch from the normal date data indication to the time data indication in said digital display mechanism; a flickering display circuit for flickering display of the time data during the service interruption; and an auxiliary power source for supplying an electric power to said clock circuit, digital display mechanism, flickering display circuit and controlling circuit during the service interruption.

3. A time recorder powered in use by a commercial power supply, comprising: a clock circuit for generating a series of clock signals; a time printing mechanism including a printing wheel; a transmission mechanism for driving the printing wheel; a motor which is rotated one cycle in response to one clock signal; a motor driving circuit normally operated by the commercial power supply for rotating the motor; an auxiliary power source for supplying power upon service interruption of the commercial power supply to the motor driving circuit; a service interruption detecting circuit for detecting the service interruption of the commercial power supply; and a controlling circuit operative upon the detection of the service interruption during the rotation of said motor for maintaining said motor driving circuit effective to rotate said motor to complete one cycle motor rotation and for maintaining said motor driving circuit ineffective to rotate said motor after the completion of the one cycle motor rotation during the service interruption to thereby save the consumption of power in the motor driving circuit.

4. A time recorder powered in use by a commercial power supply, comprising: a clock circuit for counting time to produce a clock signal; a printing mechanism for printing time data; a motor powered by the commercial power supply for driving the printing mechanism in response to the clock signal to update the time data to be printed; means for momentarily interrupting the commercial power supply to the motor; means for correcting the counted time during the interruption of the commercial power supply; a storage circuit for storing therein data representative of the corrected time; a controlling circuit operative after the recovery of the commercial power supply for rotating the motor to drive the printing mechanism according to the stored data to correct the time data to be printed by the printing mechanism; a digtal display device for receiving the clock signal to indicate the time even during the interruption of the commercial power supply; and an auxiliary power source for supplying power at least to said clock circuit and said storage circuit during the interruption of the commercial power supply.

5. A time recorder for recording time information on a recording medium and connectable in use to a main power source for normally supplying commercial power to the time recorder; the time recorder comprising: a back-up power source for supplying back-up power to the time recorder during interruption of the commercial power supply; clock means for counting time to constantly produce clock pulses; digital display means for constantly digitally indicating updated time data in response to the clock pulses; analog display means driveable for analogically indicating time information; recording means driveable for recording time information on a recording medium; driving means for driving the analog display means and recording means in response to the clock pulses to continually update the time information indicated in the analog display means and recorded by the recording means; detecting means connected to the main power source for detecting an interruption of the commercial power supply; and controlling means responsive to the detection of the commercial power supply interruption and operative for inhibiting the operation of the driving means during the commercial power supply interruption so that the driving means suspends the driving of the analog display means and recording means to thereby cause a delay between the updated time data and the displayed and recorded time information, and operative after recovery of the commercial power supply for controlling the driving means to quickly drive the analog display means and recording means to correct for the delay to thereby update the displayed and recorded time informaton according to the duration of the detected interruption of the commercial power supply.

6. A time recorder according to claim 5; including means for automatically switching from the main power source to the back-up power source upon interruption of the commercial power supply.

7. A time recorder according to claim 5; wherein the controlling means includes a memory connected to the clock means for storing therein reference time data representative of the time when the power supply interruption starts in response to the interruption detection, and means connected between the clock means and the memory for producing quick clock pulses effective to update the time information according to the difference between the reference time data stored in the memory and the updated time data constantly counted in the clock means.

8. A time recorder according to claim 5; wherein the controlling means includes a memory connected to the clock means for storing therein time interval data representative of the power supply interruption interval counted in the clock means in response to the interruption detection, and means connected to the memory for producing quick clock pulses effective to update the time information according to the time interval data.

9. A time recorder according to claim 5; wherein the controlling means includes means for controlling the digital display means to switch from updated month-and-date data indication to updated hour-and-minute data indication in response to the interruption detection.

10. A time recorder according to claim 9; wherein the means for controlling includes a flickering circuit for flickering the updated hour-and-minute indication.

11. A time recorder according to claim 5; including means for momentarily interrupting the commercial power supply to momentarily suspend the driving means.

12. A time recorder according to claim 11; wherein the controlling means includes changing means for changing the time counted in the clock means for a given amount during the momentary suspension of the driving means, a memory connected to the clock means for storing time data representative of the changed amount of time, and means for producing quick clock pulses effective to quickly drive the driving means according to the stored time data after the recovery from the momentary suspension of the driving means.

13. A time recorder according to claim 5; wherein the driving means includes a motor rotatively driven one cycle in response to one clock pulse, and converting means engaged between the motor and the analog display means and recording means for converting the one cycle rotation of the motor into one stepwise movement of the analog display means and recording means for incrementally advancing the time information.

14. A time recorder according to claim 13; wherein the controlling means includes means for momentarily maintaining the operation of the driving means after the commercial power supply interruption until the motor completes the last one cycle rotation to thereby complete the corresponding last stepwise movement of the analog display means and recording means.

15. A time recorder according to claim 13; wherein the recording means includes a stepwisely rotatable printing wheel.

16. A time recorder according to claim 15; wherein the converting means comprises a gear train engaged between the printing wheel and the motor.

17. A time recorder according to claim 16; wherein the analog display means includes rotatable hands and another gear train connected between the first-mentioned gear train and the hands.

* * * * *